US011031024B2

(12) United States Patent
Mariglio, III et al.

(10) Patent No.: US 11,031,024 B2
(45) **Date of Patent: *Jun. 8, 2021**

(54) SPATIALLY AWARE MULTIBAND COMPRESSION SYSTEM WITH PRIORITY

(71) Applicant: Boomcloud 360, Inc., Encinitas, CA (US)

(72) Inventors: Joseph Mariglio, III, Encinitas, CA (US); Zachary Seldess, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/810,608

(22) Filed: Mar. 5, 2020

(65) Prior Publication Data

US 2020/0294519 A1 Sep. 17, 2020

Related U.S. Application Data

(60) Provisional application No. 62/818,674, filed on Mar. 14, 2019.

(51) Int. Cl.
*G10L 19/008* (2013.01)
*G10L 19/083* (2013.01)
(Continued)

(52) U.S. Cl.
CPC ..... *G10L 19/083* (2013.01); *G10L 19/008* (2013.01); *G10L 19/265* (2013.01); *H04S 7/30* (2013.01); *H04S 2420/01* (2013.01)

(58) Field of Classification Search
CPC ..... G10L 19/008; H04S 2420/01; H04S 7/30
See application file for complete search history.

(56) References Cited

U.S. PATENT DOCUMENTS 8,644,526 B2 2/2014 Ehara et al.
9,191,045 B2 11/2015 Purnhagen et al.
(Continued)

FOREIGN PATENT DOCUMENTS

CN 105518776 A 4/2016
TW 201346891 A 11/2013
(Continued)

OTHER PUBLICATIONS

Favrot, A. et al., "Complementary N-Band IIR Filterbank Based on 2-Band Complementary Filters," Proceedings of the International Workshop on Acoustic Echo and Noise Control, Aug.-Sep. 2010, pp. 1-4.

(Continued)

*Primary Examiner* — Feng-Tzer Tzeng
(74) *Attorney, Agent, or Firm* — Fenwick & West LLP

(57) ABSTRACT

An audio signal is compressed in an audio coordinate system using gain factors applied in another audio coordinate system. A first component and a second component in a first audio coordinate system is generated from a third component and a fourth component of the audio signal in a second audio coordinate system. An amplitude threshold defining a level for each of the third component and the fourth component for applying compression is determined. A gain factor for the first component is generated using a compression ratio. The gain factor is applied to the first component when one of the third component or the fourth component exceeds the amplitude threshold to generate an adjusted first component. A first output channel and a second output channel in the second audio coordinate system is generated using the adjusted first component and the second component in the first audio coordinate system.

36 Claims, 13 Drawing Sheets

(51) Int. Cl.
*G10L 19/26* (2013.01)
*H04S 7/00* (2006.01)

(56) References Cited

U.S. PATENT DOCUMENTS

| | | | | |
|---|---|---|---|---|
| 9,661,438 | B1 * | 5/2017 | Yang | H04R 3/007 |
| 9,721,578 | B2 | 8/2017 | Riedmiller et al. | |
| 2009/0022328 | A1 * | 1/2009 | Neugebauer | H04S 1/005 381/27 |
| 2009/0175472 | A1 | 7/2009 | Gunnarsson | |
| 2009/0299742 | A1 | 12/2009 | Toman et al. | |
| 2013/0322633 | A1 | 12/2013 | Stone et al. | |
| 2014/0270184 | A1 * | 9/2014 | Beaton | H04S 7/307 381/17 |
| 2014/0270281 | A1 * | 9/2014 | Walsh | H04S 3/02 381/300 |
| 2015/0269948 | A1 * | 9/2015 | Purnhagen | H04S 3/02 704/500 |
| 2015/0356978 | A1 | 12/2015 | Dickins et al. | |
| 2016/0007131 | A1 | 1/2016 | Tammi et al. | |
| 2016/0210974 | A1 * | 7/2016 | Disch | G10L 19/0208 |
| 2016/0249151 | A1 | 8/2016 | Grosche et al. | |
| 2018/0018978 | A1 | 1/2018 | Bartkowiak et al. | |

FOREIGN PATENT DOCUMENTS

| | | | | |
|---|---|---|---|---|
| TW | 201503711 | A | 1/2015 | |
| WO | WO 2012/072798 | A1 | 6/2012 | |
| WO | WO-2013045693 | A2 * | 4/2013 | H04H 40/45 |
| WO | WO 2018/086947 | A1 | 5/2018 | |

OTHER PUBLICATIONS

Hicks, M., "Audio Compression Basics," Date Unknown, 13 pages, [Online] [Retrieved on Mar. 23, 2020] Retrieved from the Internet <URL: https://www.uaudio.com/blog/audio-compression-basics/>.
Williams, B., "Squeeze to Please: The Basics of Compression in Audio," Mar. 8, 2017, 24 pages, [Online] [Retrieved on Mar. 23, 2020] Retrieved from the Internet <URL: https://flypaper.soundfly.com/produce/compression-audio-basics/>.
PCT International Search Report and Written Opinion, PCT Application No. PCT/US2020/021238, dated Jul. 2, 2020, 14 pages.
PCT International Search Report and Written Opinion, PCT Application No. PCT/US2018/063152, dated Mar. 27, 2019, 12 pages.
Taiwan Intellectual Property Administration, Office Action, TW Patent Application No. 109108371, dated Mar. 29, 2021, 21 pages.
Taiwan Intellectual Property Office, Office Action, TW Patent Application No. 107145351, dated Oct. 17, 2019, ten pages.

* cited by examiner

SPATIALLY AWARE MULTIBAND COMPRESSION SYSTEM WITH PRIORITY

TECHNICAL FIELD

The subject matter described herein relates to audio processing, and more particularly to compression of an audio signal in a spatially-aware context.

BACKGROUND

Compression refers to controlling the range between the loudest and quietest parts of an audio signal. For a stereo audio signal in left-right space including a left channel and right channel, compression can be achieved in the left-right space by applying gains to the left or right channels as needed when a compression threshold is exceeded by the left or right channel. However, it is desirable to process audio signals that are not in left-right space, such as mid-side space where spatial characteristics of audio signals can be adjusted.

SUMMARY

Embodiments relate to a process (or method), as well as a system and a computer program product comprising instructions stored on a non-transitory computer readable storage medium, for providing compression of an audio signal in a spatially-aware context. The audio signal is compressed when exceeding a compression threshold in left-right space using control of mid and side components applied in mid-side space to shift artifacts of the compression to different spatial locations. This technique may also apply to the expansion of audio signals when below an expansion threshold, either on its own or in combination with compression.

By way of example, some embodiments include a method for applying compression to an audio signal. The method includes generating a first component and a second component in a first audio coordinate system from a third component and a fourth component of the audio signal in a second audio coordinate system. The method further includes determining an amplitude threshold in the second audio coordinate system defining a level for each of the third component and the fourth component for applying the compression. The method further includes generating a first gain factor for the first component using a first compression ratio defining a relationship between an amount the first component exceeds the amplitude threshold and an amount of attenuation of the first component to above the amplitude threshold when the first component exceeds the amplitude threshold. The method further includes applying the first gain factor to the first component when one of the third component or the fourth component exceeds the amplitude threshold to generate an adjusted first component. The method further includes generating a first output channel and a second output channel in the second audio coordinate system using the adjusted first component and the second component in the first audio coordinate system.

In some embodiments, the method further includes generating a second gain factor for the second component using a second compression ratio defining a relationship between an amount the second component exceeds the amplitude threshold and an amount of attenuation of the second component to above the amplitude threshold when the second component exceeds the amplitude threshold; and applying the second gain factor to the second component when one of the third component or the fourth component exceeds the amplitude threshold to generate an adjusted second component. Generating the first output channel and the second output channel using the adjusted first component and the second component includes using the adjusted second component generated from the second component.

Some embodiments include a non-transitory computer readable medium storing program code, the program code when executed by a processor configures the processor to: generate a first component and a second component in a first audio coordinate system from a third component and a fourth component of an audio signal in a second audio coordinate system; determine an amplitude threshold in the second audio coordinate system defining a level for each of the third component and the fourth component for applying compression; generate a first gain factor for the first component using a first compression ratio defining a relationship between an amount the first component exceeds the amplitude threshold and an amount of attenuation of the first component to above the amplitude threshold when the first component exceeds the amplitude threshold; apply the first gain factor to the first component when one of the third component or the fourth component exceeds the amplitude threshold to generate an adjusted first component; and generate a first output channel and a second output channel in the second audio coordinate system using the adjusted first component and the second component in the first audio coordinate system.

In some embodiments, the program code further configures the processor to: generate a second gain factor for the second component using a second compression ratio defining a relationship between an amount the second component exceeds the amplitude threshold and an amount of attenuation of the second component to above the amplitude threshold when the second component exceeds the amplitude threshold; and apply the second gain factor to the second component when one of the third component or the fourth component exceeds the amplitude threshold to generate an adjusted second component. The program code that configures the processor to generate the first output channel and the second output channel using the adjusted first component and the second component includes the program conde configuring the processor to use the adjusted second component generated from the second component.

Some embodiments include a system for applying compression to an audio signal. The system includes processing circuitry configured to: generate a first component and a second component in a first audio coordinate system from a third component and a fourth component of the audio signal in a second audio coordinate system; determine an amplitude threshold in the second audio coordinate system defining a level for each of the third component and the fourth component for applying the compression; generate a first gain factor for the first component using a first compression ratio defining a relationship between an amount the first component exceeds the amplitude threshold and an amount of attenuation of the first component to above the amplitude threshold when the first component exceeds the amplitude threshold; apply the first gain factor to the first component when one of the third component or the fourth component exceeds the amplitude threshold to generate an adjusted first component; and generate a first output channel and a second output channel in the second audio coordinate system using the adjusted first component and the second component in the first audio coordinate system.

In some embodiments, the processing circuitry is further configured to: generate a second gain factor for the second component using a second compression ratio defining a relationship between an amount the second component exceeds the amplitude threshold and an amount of attenuation of the second component to above the amplitude threshold when the second component exceeds the amplitude threshold; and apply the second gain factor to the second component when one of the third component or the fourth component exceeds the amplitude threshold to generate an adjusted second component. The processing circuitry configured to generate the first output channel and the second output channel using the adjusted first component and the second component includes the processing circuitry being configured to use the adjusted second component generated from the second component.

Figure 1:
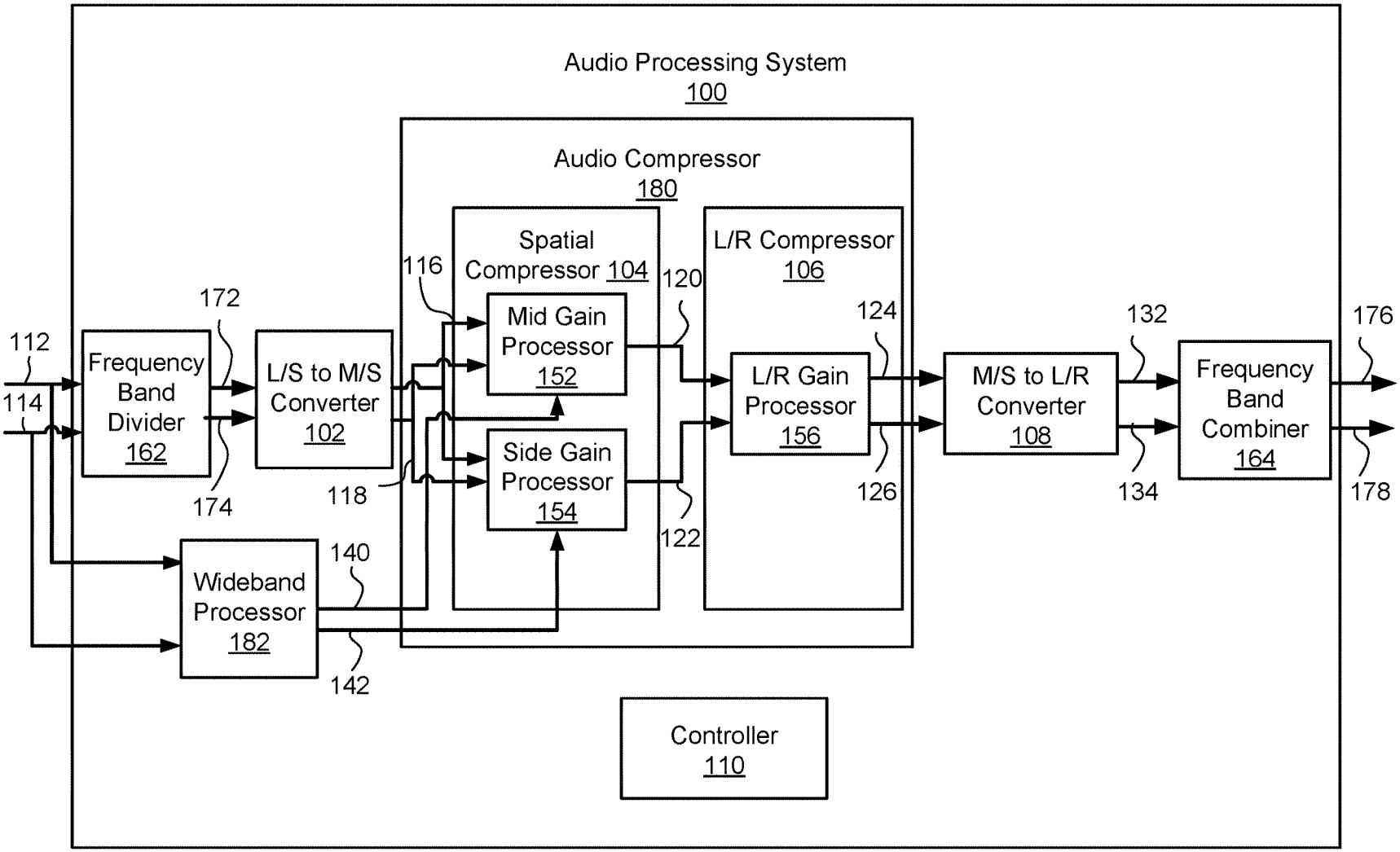
FIG. 1 is a block diagram of an audio processing system, in accordance with some embodiments.

The figures depict, and the detail description describes, various non-limiting embodiments for purposes of illustration only.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, the described embodiments may be practiced without these specific details. In other instances, well-known methods, procedures, components, circuits, and networks have not been described in detail so as not to unnecessarily obscure aspects of the embodiments.

Embodiments of the present disclosure relate to range control of an audio signal in left-right space using control applied in mid-side space. The audio signal including a left channel and a right channel are converted to a mid component and a side component. A left-right threshold that defines a maximum level that is allowed for each of the left and right channels is determined. Compression characteristics such as compression ratios, make-up gain settings, envelop parameters, and component priority settings that define priority of compression between a mid component and a side component are determined. One or more of the mid component and the side component are controlled based on the compression characteristics when the left or right channels exceed the left-right threshold. The adjusted components are converted back to left-right space into a left output channel and a right output channel that each satisfies a left-right threshold in left-right space.

The compression may be defined according to a priority of spatial limiting between the mid and side components. The priority of spatial limiting may be adjustable and defines a desired shifting of artifacts into different spatial locations to satisfy the left-right threshold.

In some embodiments, a multi-band compression is used for different subbands of the mid and side components. In some embodiments, a crossband compression is used where different subbands are controlled based on control signals derived from the wideband audio signal.

In some embodiments, multiband priority compression is applied to Multi-Input Multi-Output (MIMO) systems. By incorporating a generalized side-chain matrix, priority across subbands and spatial channels can be established.

By relaxing the requirement that a target threshold not be surpassed, gain correction artifacts may be reduced by asymmetrically smoothing the gain correction function in both the positive and negative senses without requiring lookahead. Furthermore, these nonlinear smoothing elements can be specified with distinct coefficients for distinct channels, thus providing the ability to shift artifacts into regions of the output space where perceptual masking is more likely to occur.

In some embodiments, decomposing the signal into subbands uses a phase-corrected 4th-order Linkwitz-Riley network, but this may be extended to other filter-bank topologies as well, including wavelet decompositions and short-time Fourier transform (STFT) methods.

Example Audio Processing System

FIG. 1 is a block diagram of an audio processing system 100, in accordance with some embodiments. The audio processing system 100 includes circuitry that receives an input audio signal including a left input channel 112 and a right input channel 114, and processes a mid component (or subbands of the mid component referred to as "mid subband components 116") a side component (or subbands of the side component referred to as "side subband components 118") of the channels 112, 114 to generate an output audio signal including a left output channel 176 and a right output channel 178. The audio processing system 100 applies compression to one or more of the mid component 116 or the side component 118 when the audio signal exceeds a left-right threshold $\vartheta_{LR}$ defining a level for the left and right channels for applying compression. The audio processing system 100 provides for compression of the input audio signal in a spatially-aware context because the audio processing system 100 can shift the artifacts of compression into different spatial locations (e.g., mid or side components of the input audio signal) depending on where the input energy is focused and settings that configure the operation of the audio processing system 100. The settings may be determined programmatically or may be specified by a user.

The audio processing system 100 includes a frequency band divider 162, an L/R to M/S converter 102, an audio compressor 180 including a spatial compressor 104 and an L/R compressor 106, an M/S to L/R converter 108, a frequency band combiner 164, a wideband processor 182, and a controller 110. In some embodiments, a wideband processor 182 may be included to permit crossband side-chain settings.

The frequency band divider 162 receives the left input channel 112 and the right input channel 114 and separates the channels into subband components. The left input channel 112 and the right input channel 114 may each be separated into n frequency subbands. Each of the n frequency subbands of the left input channel 112 and the right input channel 114 may correspond with a range of frequencies. For an example where n=4 frequency subbands, a frequency subband (1) may correspond to 0 to 300 Hz, a frequency subband(2) may correspond to 300 to 510 Hz, a frequency subband(3) may correspond to 510 to 2700 Hz, and a frequency subband(4) may correspond to 2700 Hz to Nyquist frequency. In some embodiments, the n frequency subbands are a consolidated set of critical bands. The critical bands may be determined using a corpus of audio samples from a wide variety of musical genres. A long term average energy ratio of mid to side components over the 24 Bark scale critical bands is determined from the samples. Contiguous frequency bands with similar long term average ratios are then grouped together to form the set of critical bands. The range of the frequency subbands, as well as the number of frequency subbands, may be adjustable. In some embodiments, the subbands generated may not represent contiguous regions of the spectrum, but instead may correspond to estimated sound sources or other separated audio components. As such, the frequency band divider 162 generates left subband components 172 from the left input channel 112, and right subband components 174 from the right input channel 114.

The L/R to M/S converter 102 receives the left subband components 172 and the right subband components 174 and generates the mid subband components 116 and the side subband components 118 from the left subband components 172 and the right subband components 174. In some embodiments, for each of the n subbands, a mid subband component may be generated based on a sum of the left subband component of the subband and the right subband component of the subband. For each of the subbands, a side component may be generated based on a difference between the left subband component of the subband and the right subband component of the subband. The mid and side components may be generated in other ways, such as using various transformations based on source-separation techniques.

In some embodiments, the mid and side components of each subband are generated from a multichannel (e.g., surround sound) audio signal. For example, multiple left channels (e.g., left, left surround, and left rear surround, etc.) may be combined to generate the left input channel 112, and multiple right channels (e.g., right, right surround, and right rear surround, etc.) may be combined to generate the right input channel 114. These additional channels may also be used to generate new spatial axes in addition to mid and side, using modifications on the L/R to M/S converter 102 to accommodate the increased dimensionality. For example, orthogonal transformations may be used to derive perceptually meaningful combinations of channels. In some embodiments, these transformations may be paired with a corresponding inverse transform in place of the M/S to L/R converter 108.

The audio compressor 180 processes the mid subband components 116 and the side subband components 118 such that the output channels 176, 178 are each limited in left-right space below a left-right compression threshold $\vartheta_{LR}$. In some embodiments, different subbands may use different left-right compression thresholds. The audio compressor 180 includes the spatial compressor 104 and the L/R compressor 106. The spatial compressor 104 includes a mid gain processor 152 and a side gain processor 154. For each subband, the mid gain processor 152 receives a mid subband component 116 and a side subband component 118 and determines a mid gain factor $\alpha_m$ for the mid subband component 116. For each subband, the mid gain processor 152 applies a mid gain factor $\alpha_m$ to the mid subband component 118 to generate an adjusted mid subband component 120. For each subband, the side gain processor 154 receives the mid subband component 116 and the side subband component 118 and determines a side gain factor $\alpha_s$ for the side subband component 118. The side gain processor 154 applies the side gain factor $\alpha_s$ to the side subband component to generate an adjusted side subband component 122. As such, the spatial compressor 104 generates an adjusted mid subband component 120 and an adjusted side subband component 122 for each of the n subbands.

In some embodiments, for each subband, there may be a priority of compression between the mid component and the side component. In some embodiment, different subbands may include different priorities for compression between the mid and side subband components or use different left-right compression thresholds $\vartheta_{LR}$.

The L/R compressor 106 includes an L/R gain processor 156. The L/R gain processor 156 receives the adjusted mid subband components 120 and the adjusted side subband components 122 as adjusted by the spatial limiter 104, and for each subband, applies a residual gain factor $\alpha_{lr}$ to the adjusted mid subband component of the subband to generate an adjusted mid subband component 124, and applies the residual gain factor $\alpha_{lr}$ to the adjusted side subband component 122 to generate an adjusted side subband component 126. As such, the L/R compressor 106 generates an adjusted mid subband component 124 and an adjusted side subband component 126 for the each of the n subbands.

As discussed in greater detail below in connection with FIGS. 4A through 6B, the gain factors $\alpha_m$, $\alpha_s$, and $\alpha_{lr}$ for each subband may vary depending on the priority of spatial compressing of the audio processing system 100. The priority for spatial compression defines a priority between the mid and side compressor stages, followed by a L/R compressor stage that is applied to both the mid and side components of each subband. Lower prioritized compressor stages may apply a gain factor that is defined using one or more gain factors applied in higher prioritized limiting stages.

The M/S to L/R converter 108 receives the adjusted mid subband components 124 and the adjusted side subband components 126 and generates adjusted left subband components 132 and adjusted right subband components 134 from the adjusted mid subband components 124 and the adjusted side subband components 126. For each subband, an adjusted left subband component 132 may be generated based on a sum of an adjusted mid component 124 and an adjusted side component 126 of the subband. For each subband, an adjusted right subband component 134 may be generated based on a difference between the adjusted mid subband component 122 and the adjusted side subband component 124 of the subband. Other types of transformations may be used to generate left and right subband components from mid and side components. As such, the M/S to L/R converter 108 generates an adjusted left subband component 132 and an adjusted right subband component 134 for the each of the n subbands.

The frequency band combiner 164 receives the adjusted left subband components 132 and the adjusted right subband components 134, and generates a left output channel 176 and a right output channel 178. The left output channel 176 may be generated by combining each of the adjusted left subband components 132. The right output channel 178 may be generated by combining each of the adjusted right subband components 134. The frequency band combiner 164 outputs the left output channel 176 to a left speaker and the right output channel 178 to a right speaker. As a result of the processing applied by the spatial compressor 104 and the L/R compressor 106, the peaks of the left output channel 176 and right output channel 178 of the output audio signal are compressed when the left input channel 112 or the right input channel 114 exceeds the left-right threshold $\vartheta_{LR}$.

The wideband processor 182 supports crossband operation of the audio processing system 100 by facilitating control of each subband with control signals 140 and 142 derived from the wideband audio signal. The wideband processor 182 generates the control signals 140 and 142 from the wideband audio signal for adjusting one or more subbands by the audio compressor 180. The wideband processor 182 receives the left channel 112 and the right channel 114 and determines wideband sidechain signal levels used by the audio compressor 180. The wideband processor 182 may be implemented as a sidechain matrix that processes the audio signal in parallel with the frequency band divider 162 and L/S to M/S converter 102. In some embodiments, such as for non-crossband operation, the wideband processor 182 may be omitted or bypassed. In some embodiments, the control signals 140 and 142 are derived from transformations, such as the application of equalization or filters, on the wideband audio signal. The sidechain matrix may then be constructed using an L/R to M/S converter to derive new mid-side components from the crossband signal 140 which may control the mid gain processor 152 or the crossband signal 142 which may control the side gain processor 154. Each of the mid gain processor 152 and side gain processor 154 can then process the components 116 and 118 as though they have the characteristics of the control signals, in a manner specified by one or more of the sidechain matrix, the LR threshold $\vartheta_{LR}$, and other parameters determined by the audio processing system 100. Because the control signals 140 and 142 are derived from the audio channels 112 and 114, and are further processed in a manner determined by the sidechain matrix, the spatial compressor 104 may thereby respond to information outside of the subband or spatial location of the components (116 and 118) to be controlled.

In some embodiments, the controller 110 controls the operations of the audio processing system 100. The controller 110 may be coupled to the other components of the audio processing system 100 to configure their operation, such as by defining of parameters (e.g., $\vartheta_{LR}$, compression ratios, make-up gain settings, envelope parameters such as attack or release time, etc.), determining priority of processing stages, and determining of gain factors in accordance with the determined priority and parameters. The various parameters used by the audio processing system 100 may be defined by user input, programmatically, or combinations thereof.

In some embodiments, the audio processing system 100 provides for wideband compression in a spatially-aware context. For example, the frequency band divider 162 and frequency band combiner 164 may be omitted, or bypassed. Rather than processing the mid and side components of each subband, the spatial compressor 104 and L/R compressor 106 process the mid and side components as wideband components, without separation into subbands. While processing of the subbands increases the types of compression that can be applied to an audio signal, wideband processing can reduce the computational requirements of the spatially aware compression.

As discussed above, the L/S to M/S converter 102, spatial compressor 104, L/R compressor 106, and M/S to L/R converter 108 may process each of n subbands. In some embodiments, the audio processing system 100 includes multiple instances of these subband processing components, each dedicated to processing one of the n subbands. Multiple subbands may be processed in parallel or in serial.

Example Spatial Compressor

Figure 2:
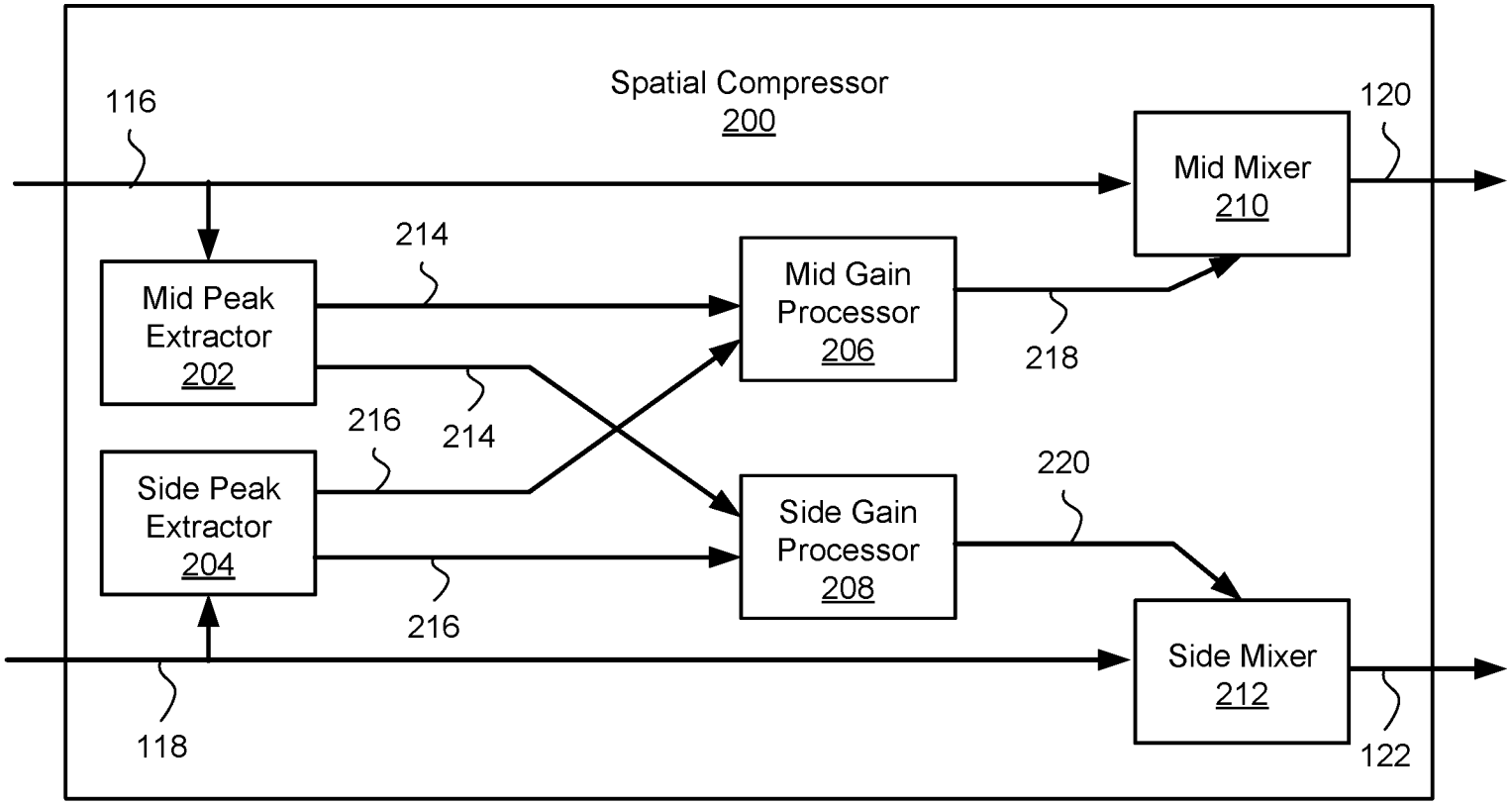
FIG. 2 is a block diagram of a spatial compressor, in accordance with some embodiments.

FIG. 2 is a block diagram of a spatial compressor 200, in accordance with some embodiments. The spatial compressor 200 is an example of a spatial compressor 104 of the audio processing system 100. Unlike the spatial compressor 104 shown in FIG. 1, the spatial compressor 200 does not use the control signals 140 and 142 from the wideband processor 182. The spatial compressor 200 uses information of a subband to control the dynamics processing algorithm applied to the subband. The spatial compressor 200 includes a mid peak extractor 202, a side peak extractor 204, a mid gain processor 206, a side gain processor 208, a mid mixer 210, and a side mixer 212. The operation of the spatial compressor 200 is discussed for processing of the mid and side subband components of one of the n subbands. Similar operation can be performed on each of the n subbands. In another example, the spatial compressor 200 provides for wideband processing where the mid and side components are not separated into subbands.

The mid peak extractor 202 receives a mid subband component 116 and determines a mid peak 214 representing a peak value of the mid subband component 116. The mid peak extractor 202 provides the mid peak 214 to the mid gain processor 206 and the side gain processor 208. The side peak extractor 204 receives the side subband component 118 and determines a side peak 216 representing a peak value of the side subband component 118. The side peak extractor 204 provides the side peak 216 to the mid gain processor 206 and the side gain processor 208.

The mid gain processor 206 determines a mid gain factor 218 ($\alpha_m$) based on the mid peak 214, the side peak 216, the compression threshold $\vartheta_{LR}$ in left-right space, and compression ratios. The side gain processor 208 determines a side gain factor 220 ($\alpha_s$) based on the mid peak 214, the side peak 216, the compression threshold $\vartheta_{LR}$ in left-right space, and compression ratios.

The mid mixer 210 receives the mid subband component 116 and the mid gain factor 218 ($\alpha_m$) and multiplies these values to generate the adjusted mid subband component 120. The side mixer 212 receives the side subband component 118 and the side gain factor 220 ($\alpha_s$) and multiplies these values to generate the adjusted side subband component 122.

In some embodiments, the L/R compressor stage is integrated with the spatial compressor 200. The mid gain processor 206 combines the residual gain factor $\alpha_{lr}$ with the mid gain factor 218, and mid mixer 210 multiples the result with the mid subband component 116 to generate the adjusted mid subband component 124. The side gain processor 208 combines the residual gain factor $\alpha_{lr}$ with the side gain factor 220, and side mixer 212 multiples the result with the side subband component 118 to generate the adjusted side subband component 126.

Frequency Band Divider

Figure 3:
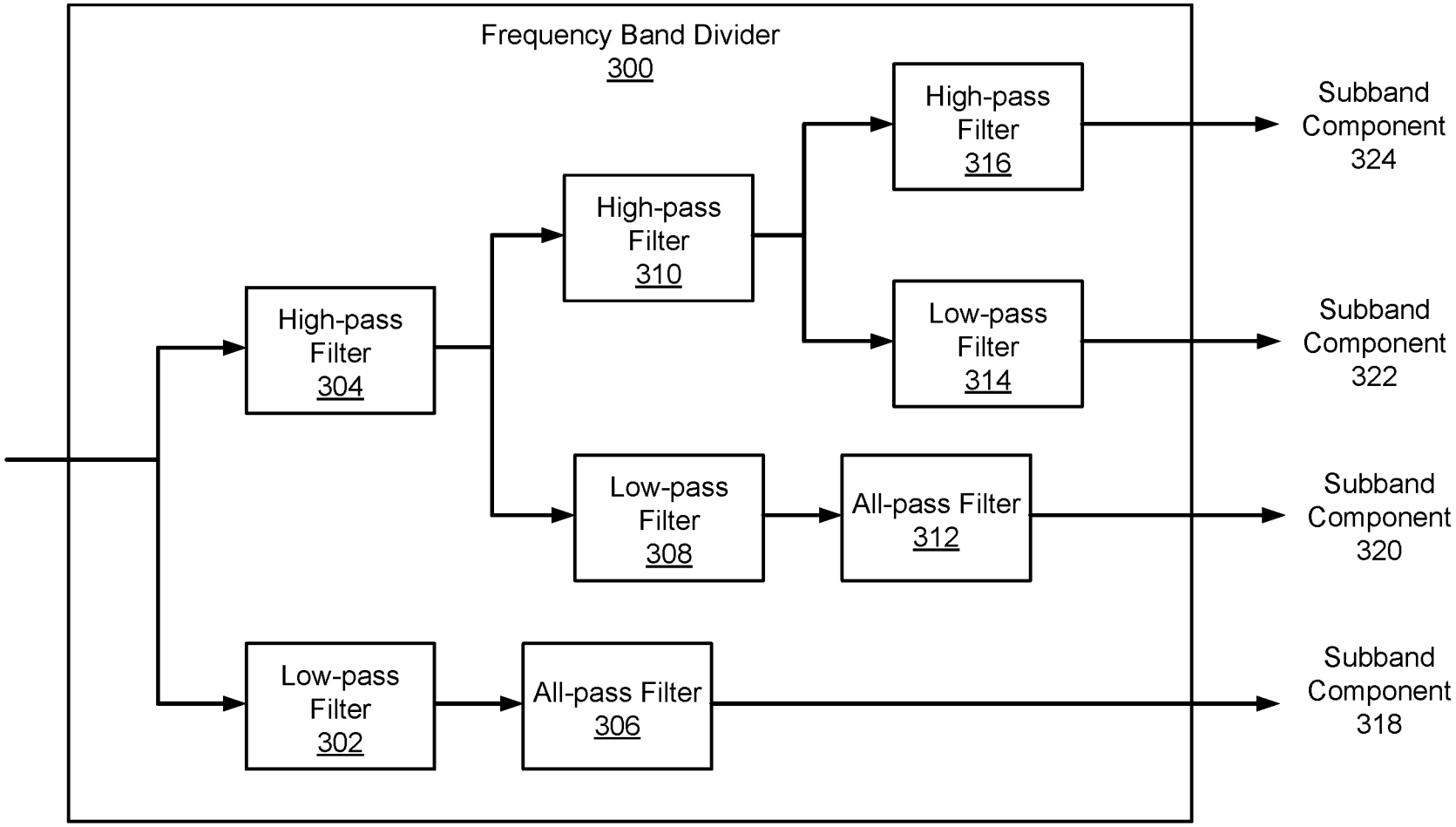
FIG. 3 is a block diagram of a frequency band divider, in accordance with some embodiments.

FIG. 3 is a block diagram of a frequency band divider 300, in accordance with some embodiments. The frequency band divider 300 is an example of the frequency band divider 162 of the audio processing system 100. The frequency band divider 300 separates an audio signal, such as the left input channel 112 or the right input channel 114, into subband components 318, 320, 322, and 324.

The frequency band divider includes a cascade of $4^{th}$ order Linkwitz-Riley crossovers with phase correction to allow for coherent summing at the output. The frequency band divider 300 includes a low-pass filter 302, high-pass filter 304, all-pass filter 306, low-pass filter 308, high-pass filter 310, all-pass filter 312, high-pass filter 316, and low-pass filter 314.

The low-pass filter 302 and high-pass filter 304 include $4^{th}$ order Linkwitz-Riley crossovers having a corner frequency (e.g., 300 Hz), and the all-pass filter 306 includes a matching $2^{nd}$ order all-pass filter. The low-pass filter 308 and high-pass filter 310 include $4^{th}$ order Linkwitz-Riley crossovers having another corner frequency (e.g., 510 Hz), and the all-pass filter 312 includes a matching $2^{nd}$ order all-pass filter. The low-pass filter 314 and high-pass filter 316 include $4^{th}$ order Linkwitz-Riley crossovers having another corner frequency (e.g., 2700 Hz). As such, the frequency band divider 300 produces the subband component 318 corresponding to the frequency subband(1) including 0 to 300 Hz, the subband component 320 corresponding to the frequency subband(2) including 300 to 510 Hz, the subband component 322 corresponding to the frequency subband(3) including 510 to 2700 Hz, and the subband component 324 corresponding to the frequency subband(4) including 2700 Hz to Nyquist frequency. In this example, the frequency band divider 300 generates n=4 subband components. The number of subband components and their corresponding frequency ranges generated by the frequency band divider 300 may vary. The subband components generated by the frequency band divider 300 allow for unbiased perfect summation, such as by the frequency band combiner 164. Although the frequency band divider 300 is discussed as being applied to left and right channels in left-right space, in some embodiments, the separation of wideband components into subbands may be applied to the mid and side components in mid-side space. In some embodiments, the subbands defined by the frequency band divider 300 may include non-contiguous sets of frequencies. In some embodiments, those constituent frequencies may vary in time, either according direct user specification or in response to the input signals.

Left-Right Space to Mid-Side Space Coordinate Transformation

Compression, whether for wideband or individual subbands, may be applied to one or both of the mid component 116 and the side component 118 of the input audio signal. To create the mid component 116 and side component 118, the L/S to M/S converter 102 may use a transformation M for converting a signal from left-right space to mid-side space as defined by Equation 1:

$$M = \begin{bmatrix} 1 & 1 \\ 1 & -1 \end{bmatrix} \frac{1}{2} \quad \text{Eq. (1)}$$

In mid-side space, various processing may be performed including subband spatial processing, crosstalk processing (e.g., crosstalk cancellation or crosstalk simulation), crosstalk compensation (e.g., adjusting for spectral artifacts caused by crosstalk processing), and gain application in the mid or side components. Processed mid and side components are converted to the left-right space as a left output channel for a left speaker and a right output channel for a right speaker, such as by the M/S to L/R converter 108.

The inverse transformation $M^{-1}$ for converting a signal from mid-side space to left-right space may be defined by Equation 2:

$$M^{-1} = \begin{bmatrix} 1 & 1 \\ 1 & -1 \end{bmatrix} \quad \text{Eq. (2)}$$

Equations 1 and 2 may be preferred to the true orthogonal form, where both forward and inverse transformations are scaled by square root of 2, for reduction in computational complexity.

Priority Compression

The priority of one channel over another (within a subband) is determined in part by permuting the order of gain correction operations. Thus, the order in which these operations are presented, with the exception of the final L/R gain correction, may vary. In cases where there is a priority hierarchy, the gain factor for the lower priority channel(s) is defined in relation to the gain-corrected higher priority channel(s). In the case where the priority hierarchy is completely horizontal, the gain factors for each channel are determined in reference to the uncorrected channel data. The gain correction calculation step involves constraints which may, in another sense, encode channel-based gain correction priority.

Figure 4A:
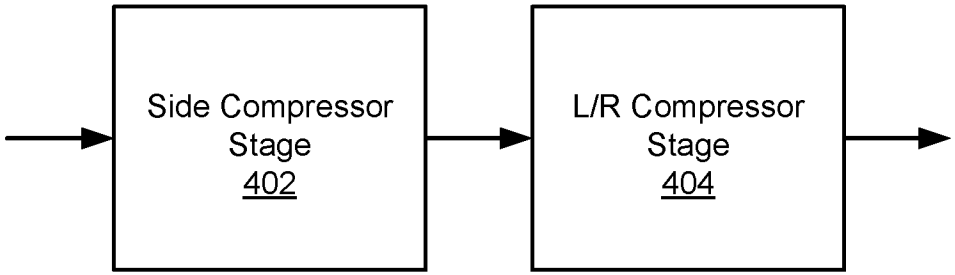
FIG. 4A is a block diagram of a side component compression followed by a L/R compression, in accordance with some embodiments.

FIG. 4A is a block diagram of a side component compression followed by a L/R compression, in accordance with some embodiments. First there is a side compressor stage 402, and then a left-right compressor stage 404. At the side compressor stage 402, a side gain factor $\alpha_s$ is applied to a side component of an audio signal. At the L/R compressor stage 404, a residual gain factor $\alpha_{lr}$ is applied to the side and mid components (or left and right components) of the audio signal. The residual gain factor $\alpha_{lr}$ is a function of the side gain factor $\alpha_s$.

Figure 4B:
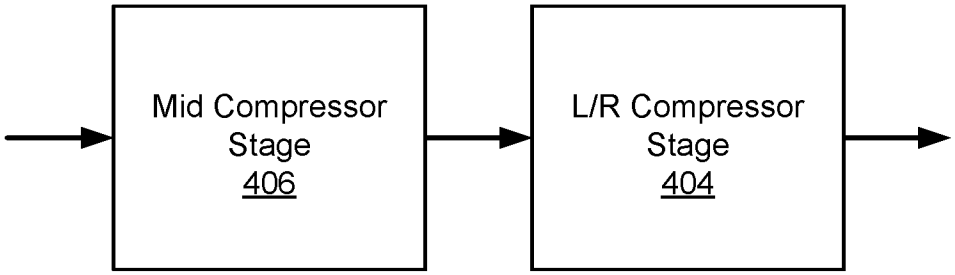
FIG. 4B is a block diagram of a mid component compression followed by a L/R compression, in accordance with some embodiments.

FIG. 4B is a block diagram of a mid component compression followed by a L/R compression, in accordance with some embodiments. First there is a mid compressor stage 406, and then a left-right compressor stage 404. At the mid compressor stage 406, a mid gain factor $\alpha_m$ is applied to a mid component of an audio signal. At the L/R compressor stage 404, a residual gain factor $\alpha_{lr}$ is applied to the side and mid components (or left and right components) of the audio signal. The residual gain factor $\alpha_{lr}$ is a function of the mid gain factor $\alpha_m$.

Figure 5:
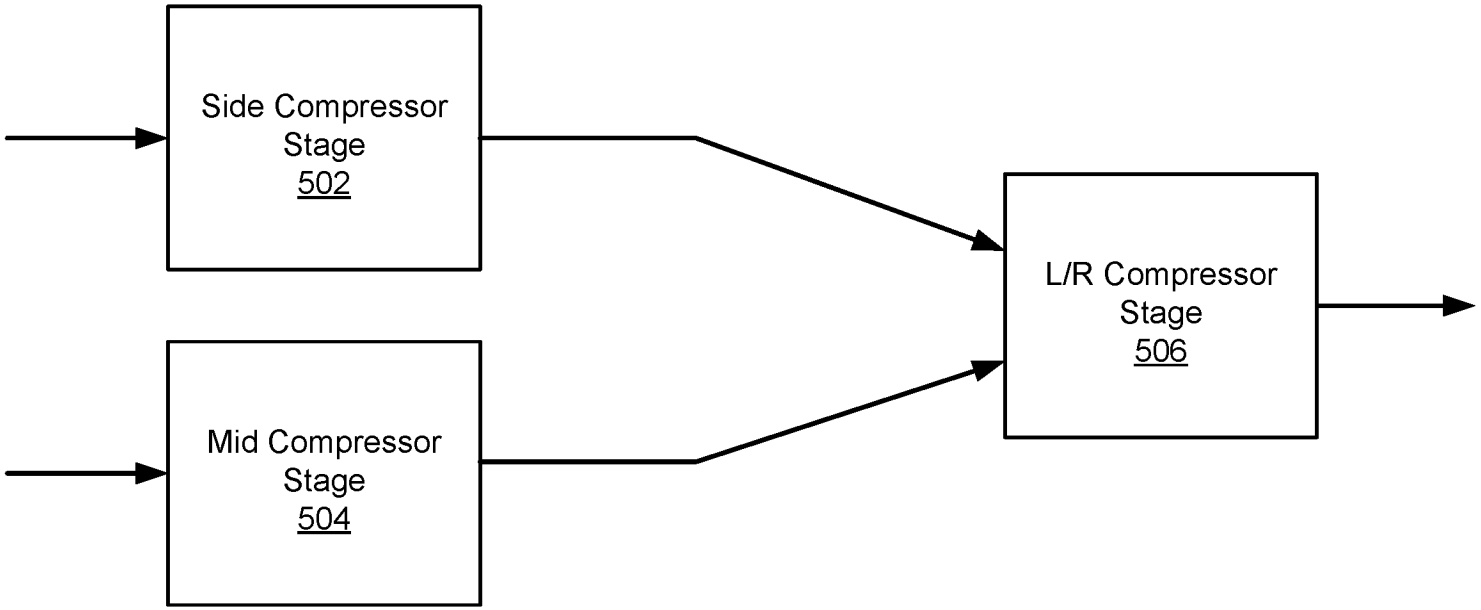
FIG. 5 is a block diagram of a mid component compression and a side component compression in parallel, followed by an L/R compression, in accordance with some embodiments.

FIG. 5 is a block diagram of a mid component compression and a side component compression in parallel, followed by an L/R compression, in accordance with some embodiments. First there is a side compressor stage 502 in parallel with a mid compressor stage 504, and an L/R compressor stage 506 following the parallel stages 502 and 504. At the side compressor stage 502, a side gain factor $\alpha_s$ is applied to a side component of an audio signal. At the mid compressor stage 504, a mid gain factor $\alpha_m$ is applied to a mid component of the audio signal. At the L/R compressor stage 506, a residual gain factor $\alpha_{lr}$ is applied to the side and mid components (or left and right components) of the audio signal. The residual gain factor $\alpha_{lr}$ is a function of the side gain factor $\alpha_s$ and mid gain factor $\alpha_m$.

Figure 6A:
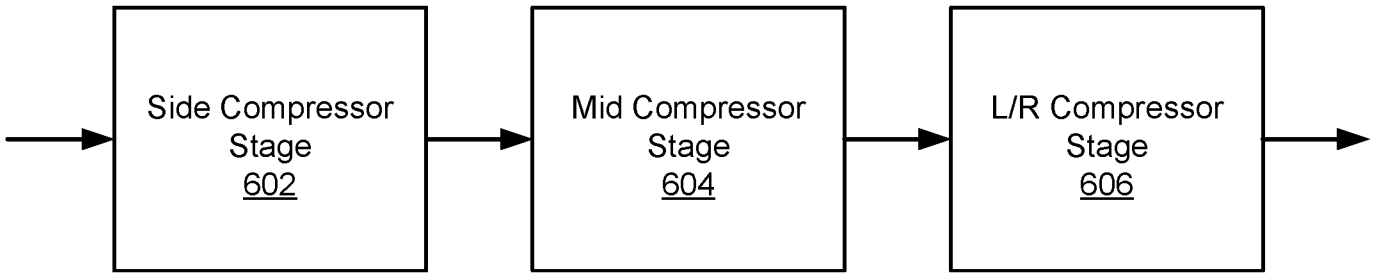
FIG. 6A is a block diagram of a side component compression, followed by a mid component compression, followed by a L/R compression, in accordance with some embodiments.

FIG. 6A is a block diagram of a side component compression, followed by a mid component compression, followed by a L/R compression, in accordance with some embodiments. First there is a side compressor stage 602 so that the side component is the primary component for compression, then a mid compressor stage 604 so that the mid component is the secondary component for compression, then a L/R limiter stage 606. At the side compressor stage 602, a side gain factor $\alpha_s$ is applied to a side component of an audio signal. At the mid compressor stage 604, a mid gain factor $\alpha_m$ is applied to a mid component of the audio signal. The mid gain factor $\alpha_m$ is a function of the side gain factor $\alpha_s$. At the L/R compressor stage 606, a residual gain factor $\alpha_{lr}$ is applied to the side and mid components (or left and right components) of the audio signal. The residual gain factor $\alpha_{lr}$ is a function of the side gain factor $\alpha_s$ and mid gain factor $\alpha_m$.

Figure 6B:
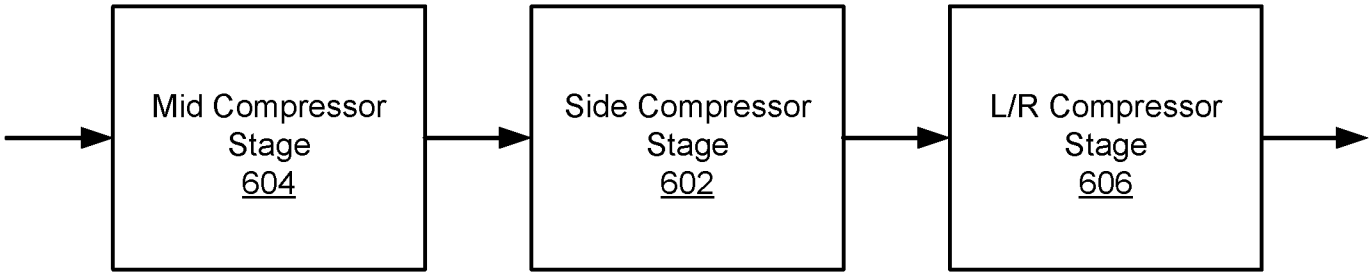
FIG. 6B is a block diagram of a mid component compression, followed by a side component compression, followed by an L/R compression, in accordance with some embodiments.

FIG. 6B is a block diagram of a mid component compression, followed by a side component compression, followed by an L/R compression, in accordance with some embodiments. First there is a mid compressor stage 604 so that the mid component is the primary component for compression, then a side compressor stage 602 such that the side component is the secondary component for compression, then a L/R compressor stage 606. At the mid compressor stage 604, a mid gain factor $\alpha_m$ is applied to a mid component of an audio signal. At the side compressor stage 602, a side gain factor $\alpha_s$ is applied to a side component of the audio signal. The side gain factor $\alpha_s$ is a function of the mid gain factor $\alpha_m$. At the L/R compressor stage 606, a residual gain factor $\alpha_{lr}$ is applied to the side and mid components (or left and right components) of the audio signal. The residual gain factor $\alpha_{lr}$ is a function of the side gain factor $\alpha_s$ and mid gain factor $\alpha_m$.

Primary Channel Gain Correction

An example is discussed below where the side component receives primary correction and the mid component receives secondary correction (e.g., as shown in FIG. 6A). The appropriate gain control coefficients for control of each of the mid component and the side component are generated based on both mid and side energy. When the side component is the primary channel for correction, a side gain factor $a_s$ is defined by Equation 3:

$$\alpha_s \equiv \min\left(\frac{\max(\vartheta_{lr} - |m_1|, 0) + \left(\frac{\max(|m_2| - \vartheta_{lr}, 0)}{r_2}\right)}{|m_2|}, 1\right) \quad \text{Eq. (3)}$$

where $\vartheta_{LR}$ is the threshold in L/R space, r2 is a compression ratio for the side component m2, and m is a two-dimensional vector representing the audio frame in M/S space including mid component m1 and side component m2, |m1| is the peak of the mid component m1, and |m2| is the peak of the side component m2. The compression ratio r2 defines a relationship between an amount the side component exceeds the left-right threshold $\vartheta_{LR}$ and an amount of attenuation of the side component to above the left-right threshold $\vartheta_{LR}$ when the side component exceeds the amplitude threshold. For example, a compression ratio r2 of 3:1 means that when the side component exceeds the left-right threshold $\vartheta_{LR}$ by 3 dB, the side component will be attenuated to 1 dB above the left-right threshold $\vartheta_{LR}$.

As defined by Equation 3, the side gain factor $a_s$ has a maximum value of 1 (e.g., no gain reduction), but may be less than 1 to apply a gain reduction. The lower value of the side gain factor $a_s$, the more gain reduction that is applied to the side component. The definition of the side gain factor $a_s$ does not include a mid gain factor $a_m$, resulting in prioritization of the side component over the mid component for compression.

Secondary Channel Gain Correction

Calculation of the gain factor for a secondary channel, in this case $a_m$, given a primary gain factor $a_m$, may be defined by Equation 4:

$$\alpha_m \equiv \min\left(\frac{\max(\vartheta_{lr} - |a_s m_2|, 0) + \left(\frac{\max(|m_1| - \vartheta_{lr}, 0)}{r_1}\right)}{|m_1|}, 1\right) \quad \text{Eq. (4)}$$

where r1 is a compression ratio for the mid component m1. The compression ratio r1 defines a relationship between an amount the mid component exceeds the left-right threshold $\vartheta_{LR}$ and an amount of attenuation of the mid component to above the left-right threshold $\vartheta_{LR}$ when the mid component exceeds the amplitude threshold.

As defined by Equation 4, the mid gain factor $a_m$ has a maximum value of 1 (e.g., no gain reduction), but may be less than 1 to apply a gain reduction. The lower value of the mid gain factor $a_m$, the more gain reduction that is applied to the mid component. The secondary mid gain factor $a_m$ is defined using the primary side gain factor $a_s$. In the case where the mid component is the primary channel and the side component is the secondary channel in terms of priority, then the gain factors $a_s$ and $a_m$, m1, m2, r1, and r2 may be swapped in Equations 3 and 4.

Residual Channel Gain Correction

If minimum gain factors are specified for $a_s$ and $a_m$, denoted $\theta_s$ and $\theta_m$ respectively, the threshold $\vartheta_{LR}$ in L/R space may not be satisfied. As such, a residual gain factor which operates on all channels simultaneously may be used to satisfy the threshold $\vartheta_{LR}$ in L/R space. This residual gain factor, denoted $a_{lr}$, is calculated in L/R space as defined by Equation 5:

$$\alpha_{lr} \equiv \min\left(\frac{\vartheta_{lr} + \left(\frac{p_{lr} - \left(\frac{\vartheta_{lr}}{2}\right)}{r_{lr}}\right)}{p_{lr}}, 1\right) \quad \text{Eq. (5)}$$

where $r_{lr}$ defines a compression ratio for the residual gain correction and $P_{lr}$ defines the worst case momentary peak value of the system as defined by Equation 6:

$$p_{lr} \equiv [\,|m_1| \quad |m_2|\,]\begin{bmatrix}1\\1\end{bmatrix} \qquad \text{Eq. (6)}$$

where $P_{lr}$ specifies a dynamic range characteristic which the output may not exceed, excluding any effects of smoothing.

Gain Factor Application

Once the gain factors $a_s$, $a_m$, and $a_{lr}$ are determined, they are applied to the mid component m1 and the side component m2 as shown by Equation 7:

$$m' \equiv \begin{cases} [m_1 \quad m_2]\begin{bmatrix}1 & 0\\0 & \alpha_s\end{bmatrix}, & \text{if } \alpha_s \geq \theta_s \\ [m_1 \quad m_2]\begin{bmatrix}\alpha_m & 0\\0 & \theta_s\end{bmatrix}, & \text{if } (\alpha_m \geq \theta_m) \wedge (\alpha_s < \theta_s) \\ [m_1 \quad m_2]\begin{bmatrix}\theta_m & 0\\0 & \theta_s\end{bmatrix}\begin{bmatrix}\alpha_{lr} & 0\\0 & \alpha_{lr}\end{bmatrix}, & \text{if } (\alpha_m < \theta_m) \wedge (\alpha_s < \theta_s) \end{cases} \qquad \text{Eq. (7)}$$

where minimum side gain factor $\theta_s$ is the minimum allowable value for the side gain factor $a_s$ and minimum mid gain factor $\theta_m$ is the minimum allowable value for the mid gain factor $a_m$.

As defined by Equation 7, if the side gain factor $a_s$ is greater than or equal to the minimum side gain factor $\theta_s$, then the side gain factor $a_s$ is applied to the side component m2 while a gain factor of 1 (or no gain) is applied to the mid component m1. Because the side component is the primary component and application of the side gain factor $a_s$ is sufficient to satisfy the threshold $\vartheta_{LR}$ in L/R space, there is no need to correct the mid component.

If the side gain factor $a_s$ is smaller than the minimum side gain factor $\theta_s$ and the mid gain factor $a_m$ is greater than or equal to the minimum mid gain factor $\theta_m$, then the minimum side gain factor $\theta_s$ is applied to the side component m2 and the mid gain factor $a_m$ is applied to the mid component m1.

If the side gain factor $a_s$ is smaller than the minimum side gain factor $\theta_s$ and the mid gain factor $a_m$ is also smaller than the minimum mid gain factor $\theta_m$, then the minimum side gain factor $\theta_s$ is applied to the side component m2, the minimum mid gain factor $\theta_m$ is applied to the mid gain component m1, and the gain factor $a_{lr}$ may be applied to each of the mid component m1 and the side component m2. The residual gain factor $a_{lr}$ may alternatively be applied to left and right channels after conversion of the mid and side components from mid-side space to left-right space.

In the case where the two (e.g., mid and side) stages of gain reduction are given equal priority, the gain correction coefficients are calculated in parallel with one another, and $a_{lr}$ is only applied if the worst case peak (after correction) exceeds $\vartheta_{LR}$ as defined by Equation 8:

$$m' \equiv \begin{cases} [m_1 \quad m_2]\begin{bmatrix}\alpha_m & 0\\0 & \alpha_s\end{bmatrix}, & \text{if } [m_1' \quad m_2']\begin{bmatrix}1\\1\end{bmatrix} < \vartheta_{lr} \\ [m_1 \quad m_2]\begin{bmatrix}\alpha_m & 0\\0 & \alpha_s\end{bmatrix}\begin{bmatrix}\alpha_{lr} & 0\\0 & \alpha_{lr}\end{bmatrix}, & \text{if } [m_1' \quad m_2']\begin{bmatrix}1\\1\end{bmatrix} \geq \vartheta_{lr} \end{cases} \qquad \text{Eq. (8)}$$

Make-Up Gain

The gain factors $a_s$, $a_m$, and $a_{lr}$ discussed above in Equations 3, 4, and 5 provide for dynamic range compression as an example of dynamic range processing which could be performed in a spatially-aware manner. As calculated, the gain factors compress the dynamic range of the peaks downward. An alternative would be to compress the quieter signals upward. These cases are virtually identical except for a final gain factor which is calculated based on the control parameters. This gain factor could be applied either in parallel to the spatial components, or the smallest gain factor could be applied equally to the spatial components, resulting in the maximum gain applicable to the signal without distorting the soundstage or clipping. In the parallel case, upward compression could be used in place of static spatial gain or equalization, for soundstage enhancement, artifact correction, etc. The make-up gain may be defined by Equation 9:

$$\mu \equiv \frac{1}{\vartheta + \frac{1-\vartheta}{r}} \qquad \text{Eq. (9)}$$

where μ is the makeup gain factor for the appropriate component, which matches the component of r and θ. If $r_{lr}$ is greater than the r for which we are calculating makeup gain, we replace r with $r_{lr}$ in Equation 9. In the case where we require coupled (scalar)μ across all dimensions, we select the minimum coefficient of μ.

Side Chain Processing

Figure 7:
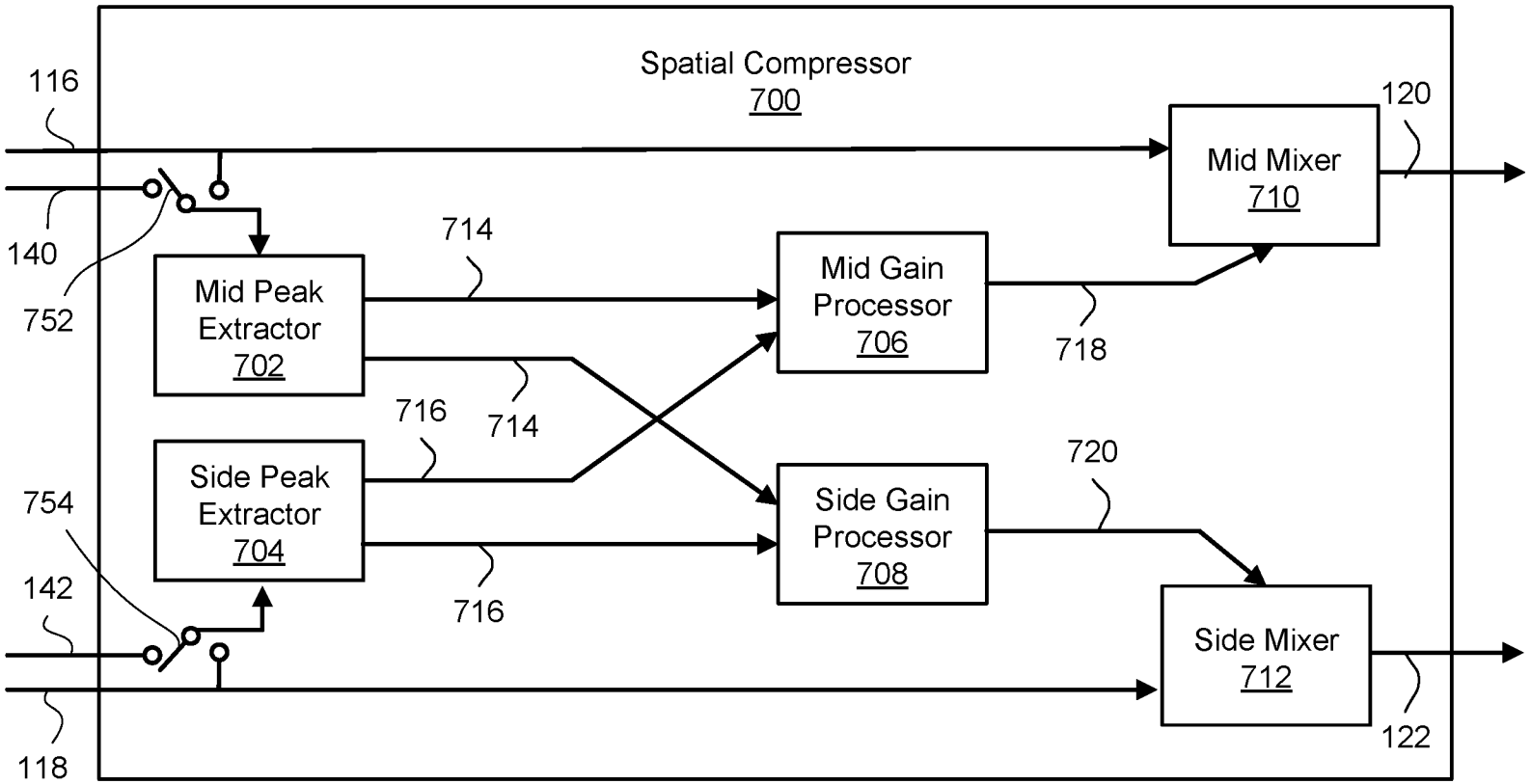
FIG. 7 is a block diagram of an audio compressor for side chain processing, in accordance with some embodiments.

FIG. 7 is a block diagram of a spatial compressor 700 for side chain processing, in accordance with some example embodiments. The spatial compressor 700 is an example of the spatial compressor 104. Side chain processing is particularly useful in cases where pumping artifacts caused by low frequencies are present in the cross stages. As popular conventions in audio mixing may include centering the low (e.g., bass) frequencies, the low frequencies of the mid component may need more gain reduction than the low frequencies of the side component.

The audio compressor 700 includes a mid peak extractor 702, a side peak extractor 704, a mid gain processor 706, a side gain processor 708, a mid mixer 710, a side mixer 712, a switch 752, and a switch 754.

The mid peak extractor 702 selectively receives one of the mid subband component 116 or the control signal 140 for a mid component from the wideband processor 182 via the switch 752. The mid peak extractor 702 determines a mid peak 714 representing a peak value of the mid subband component 116 or the control signal 140. The mid peak extractor 702 provides the mid peak 714 to the mid gain processor 706 and the side gain processor 708. The side peak extractor 704 selectively receives a side subband component 118 or the control signal 142 for a side component from the wideband processor 182 via the switch 754. The side peak extractor 704 determines a side peak 716 representing a peak value of the side subband component 118 or the control signal 142. The side peak extractor 704 provides the side peak 716 to the mid gain processor 706 and the side gain processor 708.

The mid gain processor 706 determines a gain factor 718 based on the mid peak 714, the side peak 716, and the threshold $\vartheta_{LR}$ in left-right space. The gain factor 718 may include the mid gain factor $a_m$. The side gain processor 708 determines the gain factor 720 based on the mid peak 714, the side peak 716, and the threshold $\vartheta_{LR}$ in left-right space. The gain factor 720 may include the side gain factor $a_s$.

The side chain processing may incorporate different priorities for limiting the mid or side components based on the calculations used for the mid gain factor $a_m$ and the side gain factor $a_s$. By applying additional side chain processing to the control signals, we may derive the following operator matrix:

$$\begin{bmatrix} MM & MS \\ SM & SS \end{bmatrix}$$

where each entry is an independent operator. The operator matrix provides the ability to prioritize gain control not only based on broadband spatial characteristics, but a vast number of other characteristics, such as frequency content, etc. The entry MM is an operator which defines the control of the mid gain factor $a_m$ by the mid component 116. MS is an operator which defines the control of the side gain factor $a_s$ by the mid component 116. SM is an operator which defines control of the mid gain factor $a_m$ by the side component 118. Finally, SS is an operator which defines control of the side gain factor $a_s$ by the side component 118.

In an example where priority is implemented with side chain processing, side gain processor 708 determines the gain factor 720 including the side gain factor $a_s$ using Equation 3 and the mid gain processor 706 determines the gain factor 718 including the mid factor $a_m$ using Equation 4.

The mid mixer 710 receives the mid subband component 116 and the gain factor 718 and multiplies these values to generate an adjusted mid subband component 120. The side mixer 712 receives the side subband component 118 and the gain factor 720 and multiplies these values to generate an adjusted side subband component 122.

The spatial compressor 700 may perform processing for the mid subband components 116 and side subband components 118 of each of the n subbands. Different subbands may include different gain factors. In some embodiments, such as when the audio signal is not separated into multiple subbands, the spatial compressor 700 performs processing of wideband mid and wideband side components. The switches 752 and 754 at the respective inputs of the mid peak extractor 702 and side peak extractor 704 select between two distinct configurations of the spatial compressor 700. The mid peak extractor 702 and side peak extractor 704 may derive the mid peak 714 and the side peak 716 either from the control signals 140 and 142 or from the mid subband component 116 and side subband component 118. When the control signals 140 and 142 are decoupled in this way from the components 116 and 118 to be attenuated at the mid mixer 710 and side mixer 712, the result is known as "sidechain" compression.

Control Signal Smoothing

The gain control equations described above pertain to instantaneous gain values. If these values are applied sample-by-sample without smoothing, the result will effectively be controlled hard-clipping in the appropriate subspace. The resulting artifacts are essentially high frequency modulation of the gain-control function. To reduce these artifacts, a nonlinear low-pass filter can limit the slope of the gain-control function. In cases where a totally causal gain control response is desired, the downward clamping could occur immediately, but upward movement is restricted to some maximum slope. In cases where it is possible to look ahead in a control buffer, a maximally negative downward slope limit (determined by the lookahead length) may be applied and still hit the target control gain at the appropriate peak value. Either variant shifts the artifacts to the transient stage of musical sounds, where they are perceptually masked, and simultaneously reduces their bandwidth. In some embodiments, a multivariate (e.g., rather than scalar-valued) smoothing function is used to provide spatially-aware compression.

Example Processes

Figure 8:
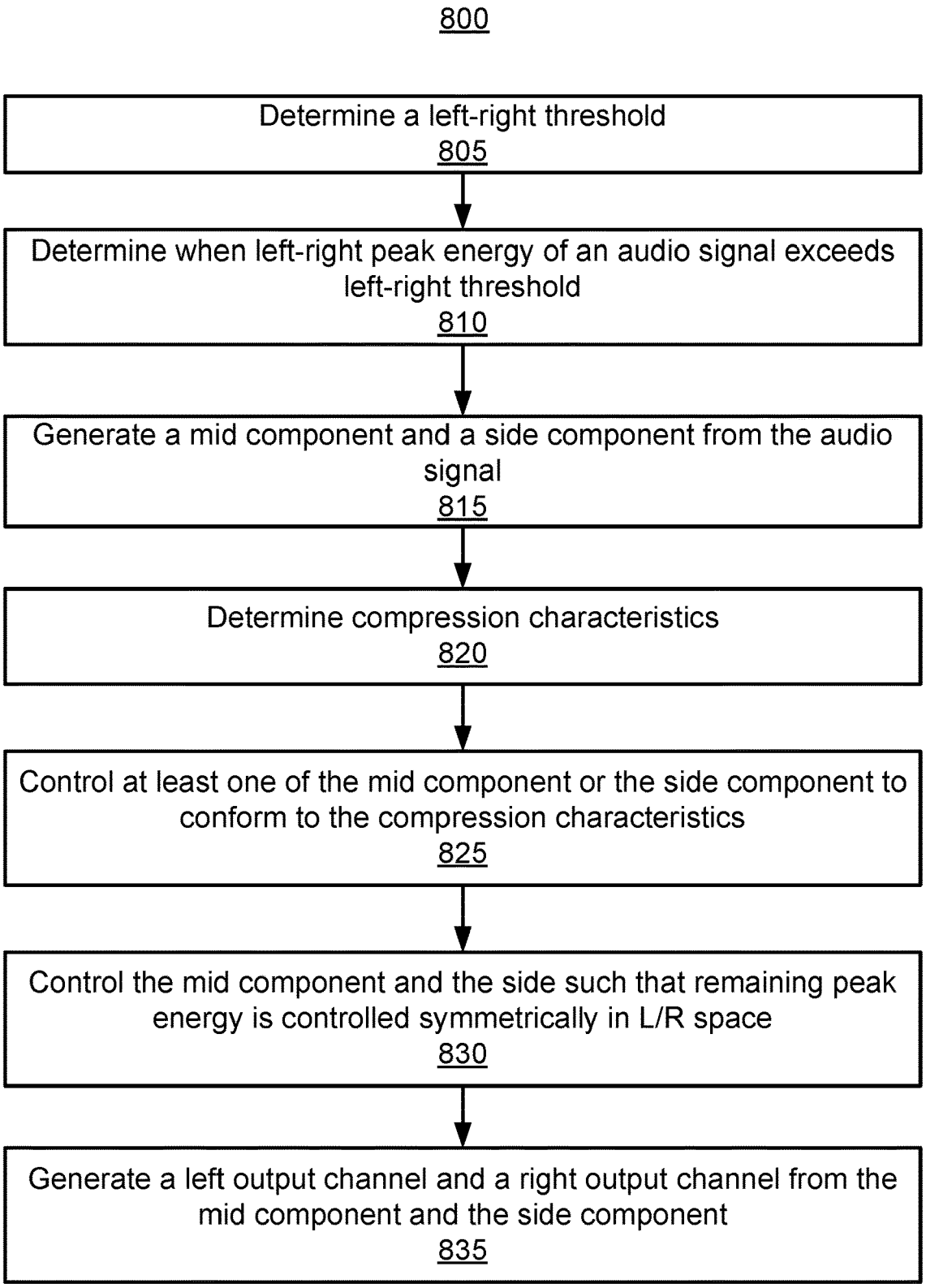
FIG. 8 is a flow chart of a process for spatially compressing an audio signal, in accordance with some embodiments.

FIG. 8 is a flow chart of a process 800 for spatially compressing an audio signal, in accordance with some embodiments. The process 800 provides for compressing the audio signal when the audio signal exceeds a threshold in left-right space by controlling mid and side components of the audio signal. The process 800 uses a wideband processing that does not separate the audio signal into multiple subbands. The process 800 may have fewer or additional steps, and steps may be performed in different orders.

An audio processing system (e.g., audio compressor 180 or controller 110) determines 805 a left-right threshold. The left-right threshold $\vartheta_{LR}$ defines a maximum level that is allowed for each of the left and right channels. For example, neither the absolute value of the left channel nor the absolute value of the right channel should exceed the left-right threshold. The left-right threshold may be defined by user input or programmatically. As discussed in greater detail below, compression is applied to the audio signal in mid-side space to ensure that the peaks of the left channel and the right channel are below the left-right threshold.

The audio processing system (e.g., audio compressor 180 or controller 110) determines 810 when the left-right peak energy of the audio signal exceeds the left-right threshold. For example, the audio processing system determines when the left channel exceeds the left-right threshold and determines when the right channel exceeds the left-right threshold.

The audio processing system (e.g., L/R to M/S converter 102) generates 815 a mid component and a side component from the audio signal. For example, in response to determining that either the peak of the left channel or the peak of the right channel exceeds the left-right threshold, the audio signal in left-right space may be converted to mid-side space for spatial compression. The mid component and side component may be determined from the left and right channels of the audio signal as defined in Equation 1. The mid component and side component represent the audio signal in mid-side space, and the left channel and the right channel represent the audio signal in left-right space. The mid component may include a sum of the left channel and the right channel. The side component may include a difference between the left channel and the right channel. In some embodiments, spatial compression may be bypassed when the peaks of the left and right channels fail to exceed the left-right threshold.

The audio processing system (e.g., audio compressor 180 or controller 110) determines 820 compression characteristics. The compression characteristics may be defined for the left, right, mid, or side components of the audio signal. These characteristics may include parameters associated with dynamic range control, such as compression ratios, make-up gain settings, or envelope parameters (e.g., attack/release time, etc.).

In some embodiments, the audio processing system implements a priority of spatial compression between the mid and side components. For example, the compression characteristics may include component priority settings that define priority of compression between the mid component and the side component. Some embodiments of spatial compression priority settings may include the designations of mid-only, side-only, mid prior to side, or side prior to mid. In embodiments where both spatial components are controlled, further variation within a given priority designation may be derived by determining a maximal amount of processing that may be applied to each component.

The audio processing system (e.g., spatial compressor 104 of the audio compressor 180) controls 825 at least one of the mid component or the side component to conform to the compression characteristics. For example, the audio processing system determines a side gain factor as for the side component as defined by Equation 3, a mid gain factor $a_m$ for the mid component as defined by Equation 4 and applies these gain factors to the side and mid components respectively. The audio processing system processes the gain of the incoming mid component 116 and side component 118 to fit the output characteristics specified by the LR threshold $\vartheta_{LR}$ and compression characteristics, to the greatest extent possible within the constraints specified. In some embodiments, these constraints include parameters such as gain reduction budgets for individual components. In embodiments that include priority, the constraints may additionally include a logical order of processing, under which the control of certain components takes priority over the control of others. Regardless of whether the embodiment specifies a given priority between mid and side components 116 and 118, both components may be used in the determination of both gain factors. In Equations 3 and 4, these components appear as the variables m1 and m2. The logical order of processing is determined by the absence of a secondary gain factor in the determination of the primary gain factor applied to the primary component, and the presence of the primary gain factor in the determination of the secondary gain factor applied to the secondary component. In some embodiments, only one of the mid component or the side component is controlled to conform to the compression characteristics.

The audio processing system (e.g., L/R compressor 106 of the audio compressor 180) controls 830 the mid and side components such that remaining peak energy is controlled symmetrically in left-right space. For example, the mid gain factor $a_m$ may be limited by the minimum mid gain factor $\theta_m$ and/or side gain factor $a_s$ may be limited by the minimum side gain factor $\theta_m$. As such, application of the mid gain factor $a_m$ and/or side gain factor $a_s$ may not be sufficient to satisfy the left-right threshold $\vartheta_{LR}$. The audio processing system determines a L/R gain factor $a_{lr}$ as defined by Equation 5 and applies the gain factor $a_{lr}$ to the side and mid components to control the remaining peak energy. In another example, the L/R gain factor $a_{lr}$ is applied to the left and right components after converting the side and mid components to left-right space.

The audio processing system (e.g., M/S to L/R converter 108) generates 835 a left output channel and a right output channel from the mid component and the side component. The left and right output channels are each limited below the left-right threshold from the control applied to each of the mid component and the side component.

The steps of the process 800 may be performed in different orders. For example, the mid and side components may be generated prior to the determination of when the left-right peak energy exceeds the left-right threshold. In some embodiments, the control of the remaining peak energy symmetrically in left-right space may be performed after conversion of the mid component and the side component into the left and right components. Here, the control may be applied to the left and right components in left-right space rather than the mid and side components in mid-side space.

Figure 9:
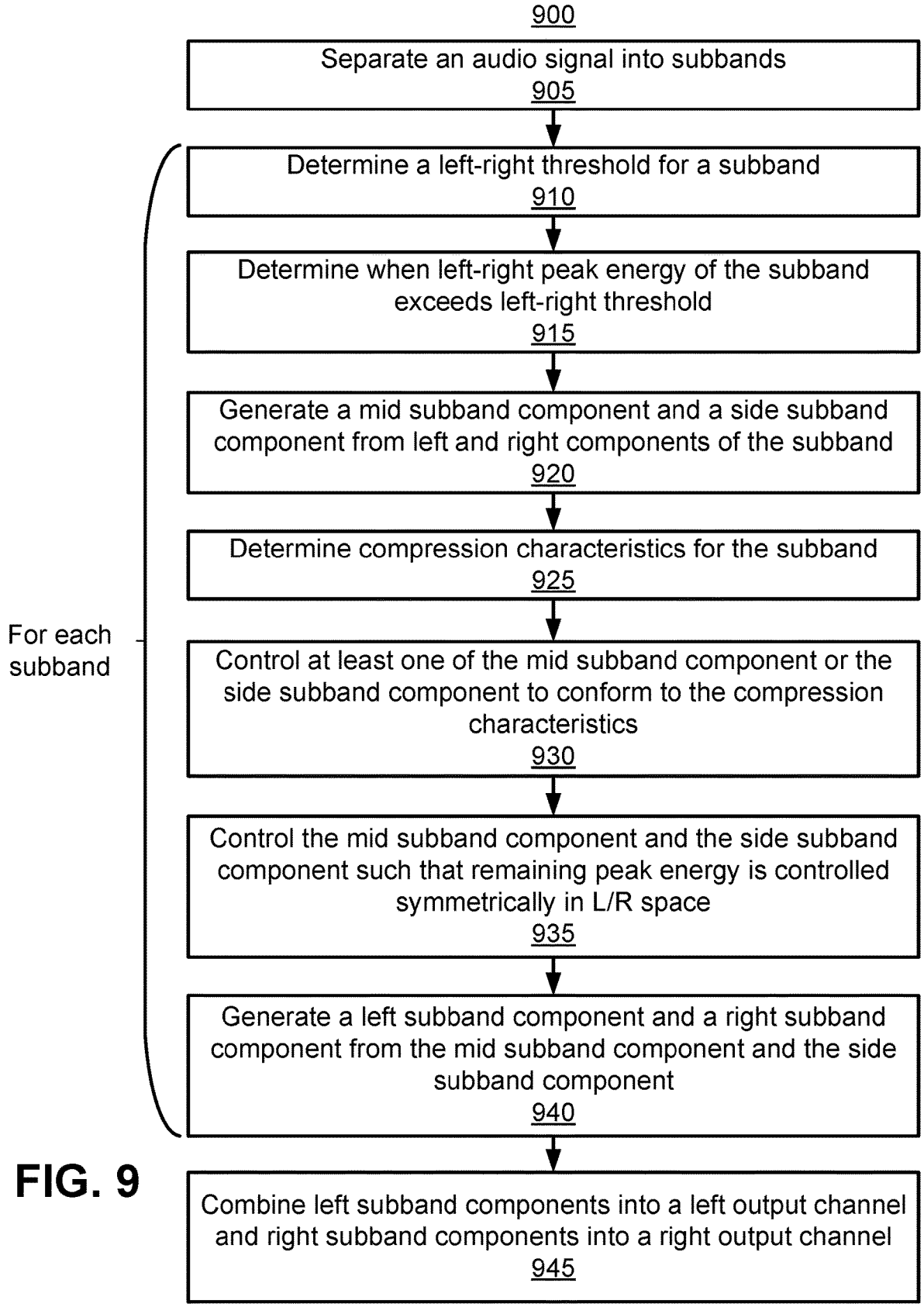
FIG. 9 is a flow chart of a process for spatially compressing an audio signal, in accordance with some embodiments.

FIG. 9 is a flow chart of a process 900 for spatially compressing an audio signal, in accordance with some embodiments. The process 900 provides for compressing the audio signal when the audio signal exceeds a left-right threshold $\vartheta_{LR}$ in left-right space by controlling mid and side components of the audio signal. The process 900 uses a multiband processing that separates the audio signal into multiple subbands and can apply different spatial compression for different subbands. The process 900 may have fewer or additional steps, and steps may be performed in different orders.

An audio processing system (e.g., frequency band divider 162) separates 905 an audio signal into subbands. For example, the audio processing system determines the crossover frequencies associated with each of the subbands and divides the audio signal into the subbands components according to the crossover frequencies.

In steps 910-940, the audio processing system processes the subbands separately. Each subband may include a left component and a right component. Spatial compression may be applied to one or more of the subbands. In some embodiments, multiple subbands are processed in parallel. The discussion regarding steps 805-830 for the wideband signal in the process 800 shown in FIG. 8 may be applicable to the steps 910-935, respectively, for each subband.

The audio processing system (e.g., audio compressor 180) determines 910 a left-right threshold for a subband. The left-right threshold $\vartheta_{LR}$ for the subband defines a maximum level that is allowed for each of the left and right components of the subband. Different subbands may have different left-right thresholds.

The audio processing system (e.g., audio compressor 180 or controller 110) determines 915 when the left-right peak energy of the subband exceeds the left-right threshold. For example, the audio processing system determines when the left component of the subband exceeds the left-right threshold of the subband and determines when the right component of the subband exceeds the left-right threshold.

The audio processing system (e.g., L/R to M/S converter 102) generates 920 a mid subband component and a side subband component from the left and right components of the subband. For example, in response to determining that either the peak of the left component or the peak of the right component of the subband exceeds the left-right threshold, the subband components in left-right space may be converted to mid-side space for spatial compression. The mid subband component may include a sum of the left channel and the right channel of the subband component The side subband component may include a difference between the left channel and the right channel of the subband component.

The audio processing system (e.g., audio compressor 180 or controller 110) determines 925 compression characteristics for the subband. The compression characteristics may include compression ratios, make-up gain settings, or envelop parameters (e.g., attack/release time, etc.). In some embodiments, the compression characteristics may include component priority settings that define priority of compression between the mid subband component and the side subband component. Different subbands may use different compression characteristics.

The audio processing system (e.g., spatial compressor 104 of the audio compressor 180) controls 930 at least one of the mid subband component or the side subband component to conform to the compression characteristics.

The audio processing system (e.g., L/R compressor 106 of the audio compressor 180) controls 935 the mid and side subband components such that remaining peak energy is controlled symmetrically in left-right space.

The audio processing system (e.g., M/S to L/R converter 108) generates 940 a left subband component and a right subband component from the mid subband component and the side subband component.

The audio processing system (e.g., frequency band combiner 164) combines 945 left subband components of multiple subbands into a left output channel and combines right subband components of multiple subbands into a right output channel. Each subband may include a left subband component and a right subband component for each subband, and the subbands are combined to generate the left and right output channels.

The steps of the process 900 may be performed in different orders. For example, the mid and side subband components of a subband may be generated prior to the determination of when the left-right peak energy exceeds the left-right threshold of the subband. In some embodiments, the control of the remaining peak energy symmetrically in left-right space may be performed after conversion of the mid subband component and the side subband component into the left and right subband components. Here, the control may be applied to the left and right components in left-right space rather than the mid and side components in mid-side space.

Figure 10:
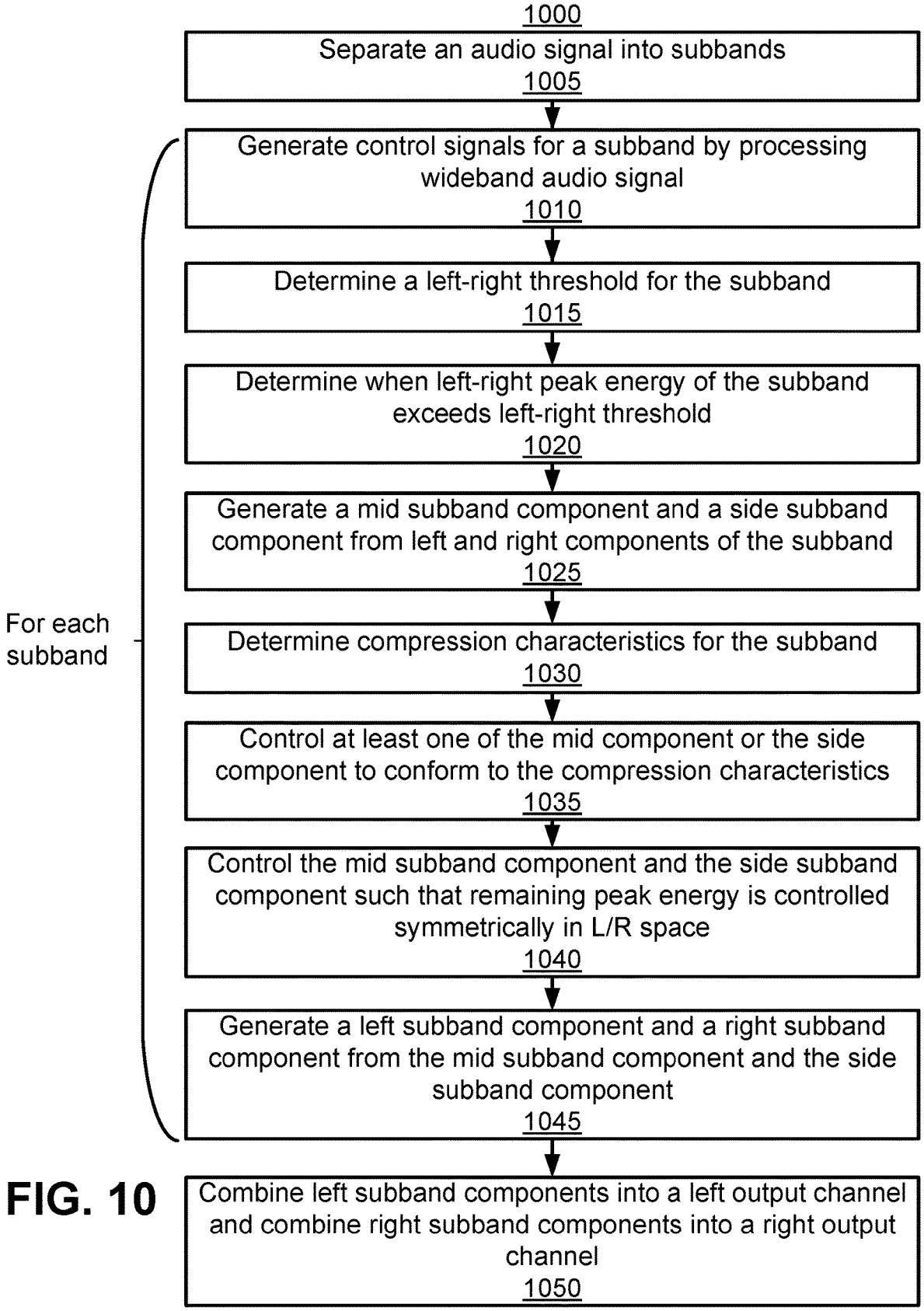
FIG. 10 is a flow chart of a process for spatially compressing an audio signal using subbands, in accordance with some embodiments.

FIG. 10 is a flow chart of a process 1000 for spatially compressing an audio signal using subbands, in accordance with some embodiments. The process 1000 includes a crossband processing that controls each subband using control signals derived from the wideband audio signal. The audio signal is separated into multiple subbands, and different spatial compression may be applied for different subbands based on control signals for the subband. The process 1000 provides for compressing the audio signal when the audio signal exceeds a threshold $\vartheta_{LR}$ in left-right space by controlling mid and side components of the audio signal. The process 1000 may have fewer or additional steps, and steps may be performed in different orders.

An audio processing system (e.g., frequency band divider 162 or controller 110) separates 1005 an audio signal into subbands. For example, the audio processing system determines the crossover frequencies associated with each of the subbands and divides the audio signal into the subbands components according to the crossover frequencies. In steps 1010-1045, the audio processing system processes multiple subbands separately.

The audio processing system (e.g., wideband processor 182 or controller 110) generates 1010 a control signal for a subband by processing the wideband audio signal. The control signal may define desired signal levels related to compression of the subband. In some embodiments, the processing of the wideband audio signal is performed using a sidechain matrix where the wideband processing is performed in parallel with processing for individual subbands in steps 1015-1020. Different subbands may include different control signals. In some embodiments, the control signal is derived from transformations, such as the application of equalization or filters, on the wideband audio signal. The sidechain matrix may then be constructed using an L/R to M/S converter to derive new mid-side components from the control signals, each of which may control the mid gain processor 152 or side gain processor 154. Each of the mid gain processor 152 and side gain processor 154 can then process the mid subband component 116 and side subband component 118 as though they have the characteristics of the control signals, in a manner determined by the sidechain matrix. Because the control signals are derived from the left and right channels 112 and 114, and further processed in a manner specified by one or more of the sidechain matrix, the LR threshold $\vartheta_{LR}$, and the compression characteristics, the audio processing system may thereby respond to information outside of the subband or spatial location of the mid subband component 116 and side subband component 118 to be controlled.

The audio processing system (e.g., audio compressor 180 or controller 110) determines 1015 a left-right threshold for the subband. The left-right threshold for the subband defines a maximum level that is allowed for each of the left and right components of the subband. Different subbands may have different left-right thresholds.

The audio processing system (e.g., audio compressor 180 or controller 110) determines 1020 when the left-right peak energy of the subband exceeds the left-right threshold. For example, the audio processing system determines when the left component of the subband exceeds the left-right threshold of the subband and determines when the right component of the subband exceeds the left-right threshold.

The audio processing system (e.g., L/R to M/S converter 102) generates 1025 a mid subband component and a side subband component from the left and right components of the subband. For example, in response to determining that either the peak of the left component or the peak of the right component of the subband exceeds the left-right threshold, the subband components in left-right space may be converted to mid-side space for spatial compression. The mid subband component may include a sum of the left channel and the right channel of the subband component The side subband component may include a difference between the left channel and the right channel of the subband component.

The audio processing system (e.g., audio compressor 180 or controller 110) determines 1030 compression characteristics for the subband. The compression characteristics may include compression ratios, make-up gain settings, or envelope parameters (e.g., attack/release time, etc.). In some embodiments, the compression characteristics may include component priority settings that define priority of compression between the mid subband component and the side subband component. Different subbands may use different compression characteristics.

The audio processing system (e.g., spatial compressor 104 of the audio compressor 180) controls 1035 at least one of the mid subband component or the side subband component to conform to the compression characteristics based on the control signals. The control signals may define wideband sidechain signal levels. The sidechain matrix (determining the weight of: the mid component of the sidechain signal controlling the mid component, the side component of the sidechain signal controlling the mid component, the mid component of the sidechain signal controlling the side component, and the side component of the sidechain signal controlling the side component) may be constructed using an L/R to M/S converter to derive new mid-side components from the control signals, each of which may control the mid or side components of the signal to be processed (e.g., by the mid gain processor 152 or side gain processor 154). Either of the mid subband component 116 and side subband component 118 may then be processed (e.g., by mid gain processor 152 or side gain processor 154) as though it has the characteristics of the wideband sidechain signals, in a manner specified by one or more of the sidechain matrix, the LR threshold $\vartheta_{LR}$, and the compression characteristics. Since this control signals are derived from the wideband audio signal (e.g., including channels 112 and 114), and further processed in a manner determined by the sidechain matrix, the audio processing system may thereby respond to information outside of the subband or spatial location of the mid subband component 116 and side subband component 118 to be controlled.

The audio processing system (e.g., L/R compressor 106 of the audio compressor 180) controls 1040 the mid and side subband components such that remaining peak energy is controlled symmetrically in left-right space.

The audio processing system (e.g., M/S to L/R converter 108) generates 1045 a left subband component and a right subband component from the mid subband component and the side subband component.

The audio processing system (e.g., frequency band combiner 164) combines 1050 left subband components of multiple subbands into a left output channel and combines right subband components of multiple subbands into a right output channel. Each subband may include a left subband component and a right subband component for each subband, and the subbands are combined to generate the left and right output channels.

The steps of the process 1000 may be performed in different orders. For example, the mid and side subband components of a subband may be generated prior to the determination of when the left-right peak energy exceeds the left-right threshold of the subband. In some embodiments, the control of the remaining peak energy symmetrically in left-right space may be performed after conversion of the mid subband component and the side subband component into the left and right subband components. Here, the control may be applied to the left and right components in left-right space rather than the mid and side components in mid-side space.

Figure 11:
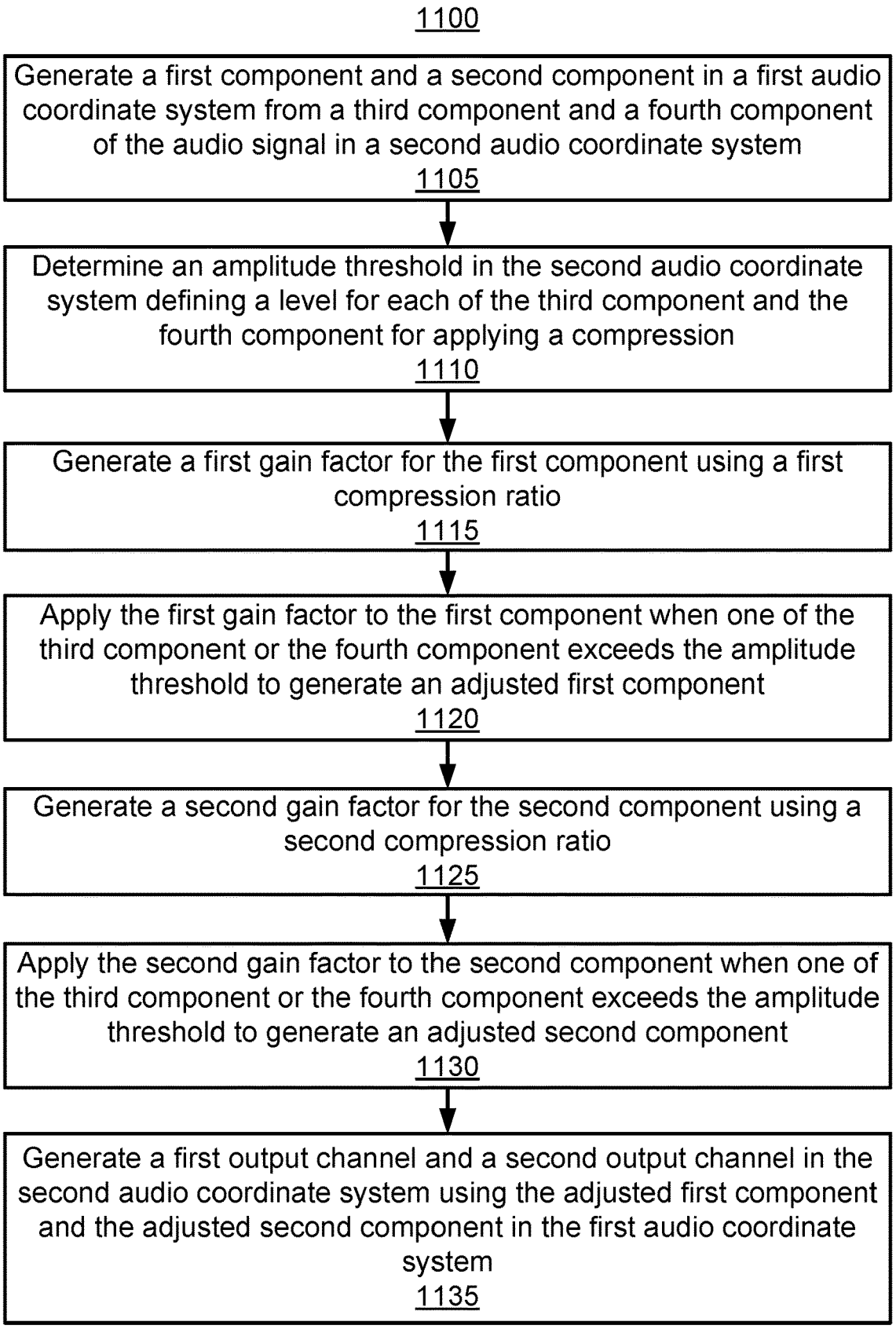
FIG. 11 is a flow chart of a process for spatially compressing an audio signal, in accordance with some embodiments.

FIG. 11 is a flow chart of a process 1100 for spatially compressing an audio signal using different audio coordinate systems, in accordance with some example embodiments. The process 1200 provides for compressing the audio signal by controlling first and second components of an audio signal in a first audio coordinate system when the audio signal exceeds an amplitude threshold in the second audio coordinate system. The process 1200 may have fewer or additional steps, and steps may be performed in different orders.

The audio processing system (e.g., audio processing system 100) generates 1105 a first component and a second component in a first audio coordinate system from a third component and a fourth component of the audio signal in a second audio coordinate system. The first audio coordinate system may be the mid-side audio coordinate system and the second audio coordinate system may be the left-right audio coordinate system, as discussed above in connection with FIGS. 1 through 10. The first and second components may include the mid and side components. The third and fourth components may include the left and right components. In another example, the first audio coordinate system may be the left-right audio coordinate system and the second audio coordinate system may include the mid-side audio coordinate system. The first and second components may include the left and right components. The third and fourth components may include the mid and side components. In some embodiments, the first, second, third, and fourth components are subband components.

The audio processing system determines 1110 an amplitude threshold in the second audio coordinate system defining a level for each of the third component and the fourth component for applying a compression. The amplitude threshold is defined in a different audio coordinate system from the audio coordinate system where gain factors are applied for the compression to satisfy the amplitude threshold.

The audio processing system generates 1115 a first gain factor for the first component using a first compression ratio. The first compression ratio may define a relationship between an amount the first component exceeds the amplitude threshold and an amount of attenuation of the first component to above the amplitude threshold when the first component exceeds the amplitude threshold. The first gain factor may include a first component gain factor (e.g., $a_s$ when the side component is the first component or $a_m$ when the mid component is the first component). In another example, the first gain factor may include the first component gain factor and a residual gain factor (e.g., $a_{lr}$). The use of a residual gain factor may depend on a comparison between the first component gain factor and a minimum first component gain factor (e.g., $\theta_s$ when the side component is the first component or $\theta_m$ when the mid component is the first component).

The audio processing system applies 1120 the first gain factor to the first component when one of the third component or the fourth component exceeds the amplitude threshold to generate an adjusted first component. Application of the first gain factor to the first component results in the first component being attenuated when the third or fourth component exceeds the amplitude threshold.

The audio processing system generates 1125 a second gain factor for the second component using a second compression ratio. The second compression ratio may define a relationship between an amount the second component exceeds the amplitude threshold and an amount of attenuation of the second component to above the amplitude threshold when the second component exceeds the amplitude threshold.

The second gain factor may include a second component gain factor (e.g., $a_s$ when the side component is the second component or $a_m$ when the mid component is the second component). In another example, the second gain factor may include the second component gain factor and the residual gain factor (e.g., $a_{lr}$). The use of the residual gain factor may depend on a comparison between the second component gain factor and a minimum second component gain factor (e.g., $\theta_s$ when the side component is the second component or $\theta_m$ when the mid component is the second component).

The audio processing system applies 1130 the second gain factor to the second component when one of the third component or the fourth component exceeds the amplitude threshold to generate an adjusted second component. Application of the second gain factor to the second component results in the second component being attenuated when the third or fourth component exceeds the amplitude threshold.

In some embodiments, the first component has a higher priority for compression than the second component. Here, the second gain factor is generated using the first gain factor. In some embodiments, a minimum first gain factor or minimum second gain factor may be used to control the application of the first and second gain factors. The minimum gain factors define gain reduction budgets the components. For example, the audio processing system may determine a minimum first gain factor for the first component and a minimum second gain factor for the second component, determine whether a first component gain factor of the first gain factor generated using the first compression ratio exceeds the minimum first gain factor, and determining whether a second component gain factor of the second gain factor generated using the second compression ratio exceeds the minimum second gain factor.

If the first component gain factor exceeds the minimum first gain factor, then the first component gain factor is applied to the first component as the first gain factor and the second gain factor is not applied to the second component. If first component gain factor fails to exceed the minimum first gain factor and the second component gain factor exceeds the minimum second gain factor, then the first component gain factor is applied to first component as the first gain factor and the second component gain factor is applied to the second component as the second gain factor. If the first component gain factor fails to exceed the minimum first gain factor and the second component gain factor fails to exceed the minimum second gain factor, then the first component gain factor and the residual gain factor is applied to the first component as the first gain factor and the second minimum gain factor and the residual gain factor is applied to the second component as the second gain factor.

In some embodiments, the first component has an equal priority for compression to the second component. The first component gain factor of the first gain factor generated using the first compression ratio is generated independently of the second gain factor, and the second component gain factor of the second gain factor generated using the second compression ratio is generated independently of the first gain factor. Furthermore, the audio processing system may determine whether a sum of the first component after application of the first component gain factor and the second component after application of the second component gain factor exceeds the amplitude threshold. The first and second gain factors may each include a residual gain factor in response to the sum exceeding the amplitude threshold.

In some embodiments, such as where the first, second, third, and fourth components are subband components of a subband, the first compression ratio and second compression ratio (as well as other compression characteristics) may be determined based on multiple subbands of the audio signal including the subband. In some embodiments, a wideband audio signal may be used to determine the compression characteristics used for one or more of the subbands.

In some embodiments, a smoothing function may be applied to the first or second gain factors to reduce artifacts of the compression.

The audio processing system generates 1135 a first output channel and a second output channel in the second audio coordinate system using the adjusted first component and the adjusted second component in the first audio coordinate system. The adjusted first and second components are the first and second components after application of gain factors. In some embodiments, only the first component or the second component is adjusted, and the output channels may be generated using only one adjusted component and an unadjusted component.

Example Wideband Processor

Figure 12:
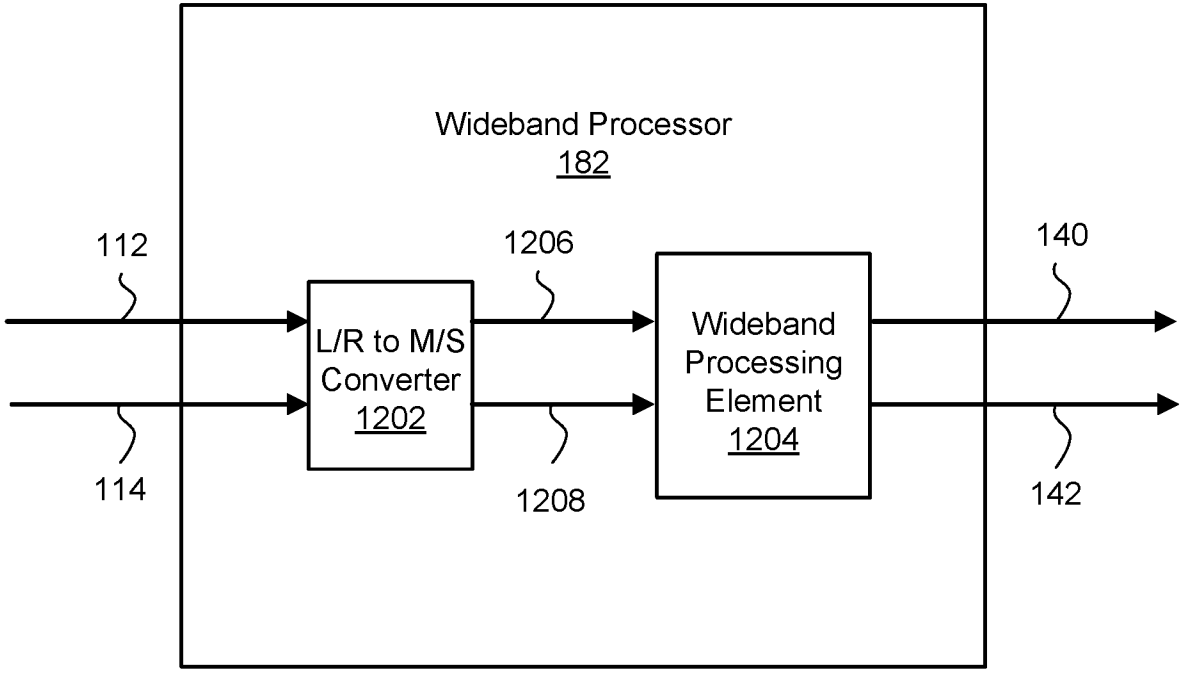
FIG. 12 is a block diagram of a wideband processor, in accordance with some embodiments.

FIG. 12 is a block diagram of a wideband processor 182, in accordance with some embodiments. The wideband processor 182 includes an L/R to M/S converter 1202 and a wideband processing element 1204. The L/R to M/S converter 1202 receives the left input channel 112 and the right input channel 114 and generates a mid component 1206 and a side component 1208. The wideband processing element 1204 processes the mid component 1206 to generate the control signal 140 and processes the side component 1208 to generate the control signal 142. The wideband processing element 1204 may include an equalization filter for each of the mid component 1206 and side component 1208. The wideband processing element 1204 provides the control signal 140 to the mid gain processor 152 of the spatial compressor 104 and provides the control signal 142 to the side gain processor 154 of the spatial compressor 104. For example, the wideband processing element may include an M/S equalizer, emphasizing the 150-250 Hz range, that may be used to control the side gain factor $\alpha_s$ in a subband spanning from 500-1000 Hz. Subsequently, in spatial compressor 700, the control signals 140 and 142 are then interpreted by the mid peak extractor 702 and side peak extractor 704, respectively, to calculate the peak values 714 and 716 which determine the gain applied to the mid and side subband components 116 & 118, using Equations 3 and 4. This is one way information from outside the subband could affect the dynamics processing algorithm applied to the subband.

Example Computer

Figure 13:
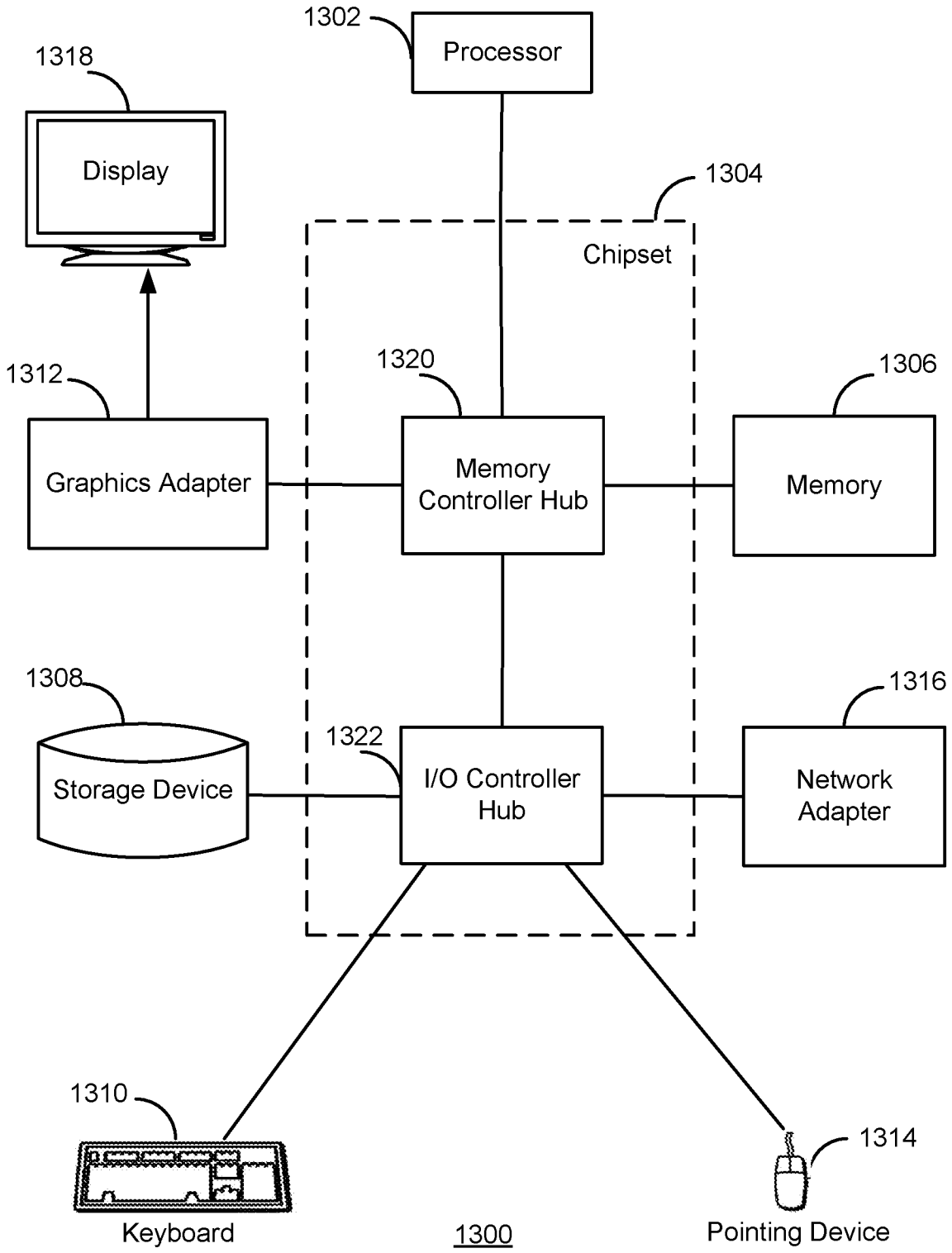
FIG. 13 is a block diagram of a computer, in accordance with some embodiments.

FIG. 13 is a block diagram of a computer 1300, in accordance with some embodiments. The computer 1300 is an example of circuitry that implements an audio processing system. Illustrated are at least one processor 1302 coupled to a chipset 1304. The chipset 1304 includes a memory controller hub 1320 and an input/output (I/O) controller hub 1322. A memory 1306 and a graphics adapter 1312 are coupled to the memory controller hub 1320, and a display device 1318 is coupled to the graphics adapter 1312. A storage device 1308, keyboard 1310, pointing device 1314, and network adapter 1316 are coupled to the I/O controller hub 1322. The computer 1300 may include various types of input or output devices. Other embodiments of the computer 1300 have different architectures. For example, the memory 1306 is directly coupled to the processor 1302 in some embodiments.

The storage device 1308 includes one or more non-transitory computer-readable storage media such as a hard drive, compact disk read-only memory (CD-ROM), DVD, or a solid-state memory device. The memory 1306 holds program code (comprised of one or more instructions) and data used by the processor 1302. The program code may correspond to the processing aspects described with FIGS. 1 through 11.

The pointing device 1314 is used in combination with the keyboard 1310 to input data into the computer system 1300. The graphics adapter 1312 displays images and other information on the display device 1318. In some embodiments, the display device 1318 includes a touch screen capability for receiving user input and selections. The network adapter 1316 couples the computer system 1300 to a network. Some embodiments of the computer 1300 have different and/or other components than those shown in FIG. 13.

ADDITIONAL CONSIDERATIONS

Some example benefits and advantages of the disclosed configuration include compressing an audio signal in left-right space using gain factors applied in mid-side space to shift artifacts of compression to different spatial locations, and the preferences specified by the user. Processing of mid or side components of audio signals is used in various types of audio processing, and spatial priority compression as discussed herein provides for more computationally efficient integration with such processing techniques in mid/side space. These preferences are specified, at the lowest level, as thresholds between which the compressor enters different regimes of operation, and the logical ordering of those regimes of operation. At a higher level, this can be understood as a trade-off between the artifacts of various soundstage distortions and the artifacts of traditional dynamic range processing. The techniques discussed herein for compression may also apply to the expansion of audio signals when below an expansion threshold. Expansion may be performed on an audio signal either on its own or in combination with compression.

While particular embodiments and applications have been illustrated and described, it is to be understood that the invention is not limited to the precise construction and components disclosed herein and that various modifications, changes and variations which will be apparent to those skilled in the art may be made in the arrangement, operation and details of the method and apparatus disclosed herein without departing from the spirit and scope of the present disclosure.

What is claimed is:

1. A method for applying compression to an audio signal, comprising, by a processing circuitry:

generating a first component and a second component in a first audio coordinate system from a third component and a fourth component of the audio signal in a second audio coordinate system;

determining an amplitude threshold in the second audio coordinate system defining a level for each of the third component and the fourth component for applying the compression;

generating a first gain factor for the first component using a first compression ratio defining a relationship between an amount the first component exceeds the amplitude threshold and an amount of attenuation of the first component to above the amplitude threshold;

applying the first gain factor to the first component when one of the third component or the fourth component exceeds the amplitude threshold to generate an adjusted first component; and generating a first output channel and a second output channel in the second audio coordinate system using the adjusted first component and the second component in the first audio coordinate system.

2. The method of claim 1, further comprising, by the processing circuitry:

generating a second gain factor for the second component using a second compression ratio defining a relationship between an amount the second component exceeds the amplitude threshold and an amount of attenuation of the second component to above the amplitude threshold when the second component exceeds the amplitude threshold; and applying the second gain factor to the second component when one of the third component or the fourth component exceeds the amplitude threshold to generate an adjusted second component, wherein generating the first output channel and the second output channel using the adjusted first component and the second component includes using the adjusted second component generated from the second component.

3. The method of claim 2, wherein:

the first component has a higher priority for compression than the second component; and the second gain factor is generated using the first gain factor.

4. The method of claim 3, further comprising, by the processing circuitry:

determining a minimum first gain factor for the first component and a minimum second gain factor for the second component;

determining whether a first component gain factor of the first gain factor generated using the first compression ratio exceeds the minimum first gain factor; and determining whether a second component gain factor of the second gain factor generated using the second compression ratio exceeds the minimum second gain factor, the minimum first gain factor being applied to the first component as the first gain factor and the second component gain factor being applied to the second component as the second gain factor in response to determining the first component gain factor fails to exceed the minimum first gain factor and the second component gain factor exceeds the minimum second gain factor.

5. The method of claim 3, wherein generating the first gain factor includes:

determining a minimum first gain factor for the first component and a minimum second gain factor for the second component;

determining whether a first component gain factor of the first gain factor generated using the first compression ratio exceeds the minimum first gain factor; and determining whether a second component gain factor of the second gain factor generated using the second compression ratio exceeds the minimum second gain factor, the first gain factor and the second gain factor each including a residual gain factor in response to determining the first component gain factor fails to exceed the minimum first gain factor and the second component gain factor fails to exceed the minimum second gain factor.

6. The method of claim 5, wherein the first gain factor includes the minimum first gain factor and the second gain factor includes the minimum second gain factor in response to the first component gain factor failing to exceed the minimum first gain factor and the second component gain factor failing to exceed the minimum second gain factor.

7. The method of claim 2, wherein:

the first component has an equal priority for compression to the second component;

a first component gain factor of the first gain factor generated using the first compression ratio is generated independently of the second gain factor; and a second component gain factor of the second gain factor generated using the second compression ratio is generated independently of the first gain factor.

8. The method of claim 7, further comprising, by the processing circuitry, determining whether a sum of the first component after application of the first component gain factor and the second component after application of the second component gain factor exceeds the amplitude threshold, the first and second gain factors each including a residual gain factor in response to the sum exceeding the amplitude threshold.

9. The method of claim 1, wherein:

the first component is one of a mid component or a side component of the audio signal;

the first audio coordinate system is a mid-side audio coordinate system;

the third component is a left component of the audio signal;

the fourth component is a right component of the audio signal; and the second audio coordinate system is a left-right audio coordinate system.

10. The method of claim 1, wherein:

the first component is one of a mid subband component or a side subband component of a subband of the audio signal;

the first audio coordinate system is a mid-side audio coordinate system;

the third component is a left subband component of the subband of the audio signal;

the fourth component is a right subband component of the subband of the audio signal; and the second audio coordinate system is a left-right audio coordinate system.

11. The method of claim 10, further comprising, by the processing circuitry, determining the first compression ratio based on multiple subbands of the audio signal including the subband.

12. The method of claim 1, further comprising applying a smoothing function to the first gain factor.

13. A non-transitory computer readable medium storing program code, the program code when executed by a processor configures the processor to:

generate a first component and a second component in a first audio coordinate system from a third component and a fourth component of an audio signal in a second audio coordinate system;

determine an amplitude threshold in the second audio coordinate system defining a level for each of the third component and the fourth component for applying compression;

generate a first gain factor for the first component using a first compression ratio defining a relationship between an amount the first component exceeds the amplitude threshold and an amount of attenuation of the first component to above the amplitude threshold;

apply the first gain factor to the first component when one of the third component or the fourth component exceeds the amplitude threshold to generate an adjusted first component; and generate a first output channel and a second output channel in the second audio coordinate system using the adjusted first component and the second component in the first audio coordinate system.

14. The computer readable medium of claim 13, wherein the program code further configures the processor to:

generate a second gain factor for the second component using a second compression ratio defining a relationship between an amount the second component exceeds the amplitude threshold and an amount of attenuation of the second component to above the amplitude threshold when the second component exceeds the amplitude threshold; and apply the second gain factor to the second component when one of the third component or the fourth component exceeds the amplitude threshold to generate an adjusted second component, and wherein the program code that configures the processor to generate the first output channel and the second output channel using the adjusted first component and the second component includes the program conde configuring the processor to use the adjusted second component generated from the second component.

15. The computer readable medium of claim 14, wherein the first component has a higher priority for compression than the second component; and the second gain factor is generated using the first gain factor.

16. The computer readable medium of claim 15, wherein the program code further configures the processor to:

determine a minimum first gain factor for the first component and a minimum second gain factor for the second component;

determine whether a first component gain factor of the first gain factor generated using the first compression ratio exceeds the minimum first gain factor; and determine whether a second component gain factor of the second gain factor generated using the second compression ratio exceeds the minimum second gain factor, the minimum first gain factor being applied to the first component as the first gain factor and the second component gain factor being applied to the second component as the second gain factor in response to determining the first component gain factor fails to exceed the minimum first gain factor and the second component gain factor exceeds the minimum second gain factor.

17. The computer readable medium of claim 15, wherein the program code that configures the processor to generate the first gain factor includes program code that configures the processor to:

determine a minimum first gain factor for the first component and a minimum second gain factor for the second component;

determine whether a first component gain factor of the first gain factor generated using the first compression ratio exceeds the minimum first gain factor; and determining whether a second component gain factor of the second gain factor generated using the second compression ratio exceeds the minimum second gain factor, the first gain factor and the second gain factor each including a residual gain factor in response to determining the first component gain factor fails to exceed the minimum first gain factor and the second component gain factor fails to exceed the minimum second gain factor.

18. The computer readable medium of claim 17, wherein first gain factor includes the minimum first gain factor and the second gain factor includes the minimum second gain factor in response to the first component gain factor failing to exceed the minimum first gain factor and the second component gain factor failing to exceed the minimum second gain factor.

19. The computer readable medium of claim 14, wherein:

the first component has an equal priority for compression to the second component;

a first component gain factor of the first gain factor generated using the first compression ratio is generated independently of the second gain factor; and a second component gain factor of the second gain factor generated using the second compression ratio is generated independently of the first gain factor.

20. The computer readable medium of claim 19, wherein the program code further configures the processor to determine whether a sum of the first component after application of the first component gain factor and the second component after application of the second component gain factor exceeds the amplitude threshold, the first and second gain factors each including a residual gain factor in response to the sum exceeding the amplitude threshold.

21. The computer readable medium of claim 13, wherein:

the first component is one of a mid component or a side component of the audio signal;

the first audio coordinate system is a mid-side audio coordinate system;

the third component is a left component of the audio signal;

the fourth component is a right component of the audio signal; and the second audio coordinate system is a left-right audio coordinate system.

22. The computer readable medium of claim 13, wherein:

the first component is one of a mid subband component or a side subband component of a subband of the audio signal;

the first audio coordinate system is a mid-side audio coordinate system;

the third component is a left subband component of the subband of the audio signal;

the fourth component is a right subband component of the subband of the audio signal; and the second audio coordinate system is a left-right audio coordinate system.

23. The computer readable medium of claim 22, wherein the program code further configures the processor to determine the compression ratio based on multiple subbands of the audio signal including the subband.

24. The computer readable medium of claim 21, wherein the program code further configures the processor to apply a smoothing function to the first gain factor.

25. A system for applying compression to an audio signal, comprising:

processing circuitry configured to:

generate a first component and a second component in a first audio coordinate system from a third component and a fourth component of the audio signal in a second audio coordinate system;

determine an amplitude threshold in the second audio coordinate system defining a level for each of the third component and the fourth component for applying the compression;

generate a first gain factor for the first component using a first compression ratio defining a relationship between an amount the first component exceeds the amplitude threshold and an amount of attenuation of the first component to above the amplitude threshold;

apply the first gain factor to the first component when one of the third component or the fourth component exceeds the amplitude threshold to generate an adjusted first component; and generate a first output channel and a second output channel in the second audio coordinate system using the adjusted first component and the second component in the first audio coordinate system.

26. The system of claim 25, wherein the processing circuitry is further configured to:

generate a second gain factor for the second component using a second compression ratio defining a relationship between an amount the second component exceeds the amplitude threshold and an amount of attenuation of the second component to above the amplitude threshold when the second component exceeds the amplitude threshold; and apply the second gain factor to the second component when one of the third component or the fourth component exceeds the amplitude threshold to generate an adjusted second component, and wherein the processing circuitry configured to generate the first output channel and the second output channel using the adjusted first component and the second component includes the processing circuitry being configured to use the adjusted second component generated from the second component.

27. The system of claim 26, wherein:

the first component has a higher priority for compression than the second component; and the second gain factor is generated using the first gain factor.

28. The system of claim 27, wherein the processing circuitry is further configured to:

determine a minimum first gain factor for the first component and a minimum second gain factor for the second component;

determine whether a first component gain factor of the first gain factor generated using the first compression ratio exceeds the minimum first gain factor; and determine whether a second component gain factor of the second gain factor generated using the second compression ratio exceeds the minimum second gain factor, the minimum first gain factor being applied to the first component as the first gain factor and the second component gain factor being applied to the second component as the second gain factor in response to determining the first component gain factor fails to exceed the minimum first gain factor and the second component gain factor exceeds the minimum second gain factor.

29. The system of claim 27, wherein the processing circuitry configured to generate the first gain factor includes the processing circuitry being configured to:

determine a minimum first gain factor for the first component and a minimum second gain factor for the second component;

determine whether a first component gain factor of the first gain factor generated using the first compression ratio exceeds the minimum first gain factor; and determining whether a second component gain factor of the second gain factor generated using the second compression ratio exceeds the minimum second gain factor, the first gain factor and the second gain factor each including a residual gain factor in response to determining the first component gain factor fails to exceed the minimum first gain factor and the second component gain factor fails to exceed the minimum second gain factor.

30. The system of claim 29, wherein the first gain factor includes the minimum first gain factor and the second gain factor includes the minimum second gain factor in response to the first component gain factor failing to exceed the minimum first gain factor and the second component gain factor failing to exceed the minimum second gain factor.

31. The system of claim 26, wherein:

the first component has an equal priority for compression to the second component;

a first component gain factor of the first gain factor generated using the first compression ratio is generated independently of the second gain factor; and a second component gain factor of the second gain factor generated using the second compression ratio is generated independently of the first gain factor.

32. The system of claim 31, wherein the processing circuitry is further configured to determine whether a sum of the first component after application of the first component gain factor and the second component after application of the second component gain factor exceeds the amplitude threshold, the first and second gain factors each including a residual gain factor in response to the sum exceeding the amplitude threshold.

33. The system of claim 25, wherein:

the first component is one of a mid component or a side component of the audio signal;

the first audio coordinate system is a mid-side audio coordinate system;

the third component is a left component of the audio signal;

the fourth component is a right component of the audio signal; and the second audio coordinate system is a left-right audio coordinate system.

34. The system of claim 25, wherein:

the first component is one of a mid subband component or a side subband component of a subband of the audio signal;

the first audio coordinate system is a mid-side audio coordinate system;

the third component is a left subband component of the subband of the audio signal;

the fourth component is a right subband component of the subband of the audio signal; and the second audio coordinate system is a left-right audio coordinate system.

35. The system of claim 34, wherein the processing circuitry is further configured to determine the first compression ratio based on multiple subbands of the audio signal including the subband.

36. The system of claim 25, wherein the processing circuitry is further configured to apply a smoothing function to the first gain factor.

* * * * *